United States Patent [19]

Furuya

[11] Patent Number: 4,662,702

[45] Date of Patent: May 5, 1987

[54] ELECTRIC CONTACTS AND ELECTRIC CONNECTORS

[75] Inventor: Kiyoto Furuya, Yokohama, Japan

[73] Assignee: Daiichi Denshi Kagyo Kabushiki Kaisha, Japan

[21] Appl. No.: 797,877

[22] Filed: Nov. 14, 1985

[30] Foreign Application Priority Data

| | | | |
|---|---|---|---|
| Nov. 15, 1984 | [JP] | Japan | 59-239518 |
| Nov. 15, 1984 | [JP] | Japan | 59-239519 |
| Nov. 15, 1984 | [JP] | Japan | 59-172360[U] |
| Nov. 15, 1984 | [JP] | Japan | 59-172361 |
| Nov. 15, 1984 | [JP] | Japan | 59-172362 |
| Dec. 11, 1984 | [JP] | Japan | 59-186744 |
| Dec. 11, 1984 | [JP] | Japan | 59-186745 |
| Dec. 11, 1984 | [JP] | Japan | 59-186746 |
| Dec. 11, 1984 | [JP] | Japan | 59-186747 |
| Dec. 11, 1984 | [JP] | Japan | 59-186748 |
| Dec. 11, 1984 | [JP] | Japan | 59-186749 |

[51] Int. Cl.[4] ..... H01R 13/00

[52] U.S. Cl. ..... 339/176 MP; 339/278 C

[58] Field of Search ..... 339/30, 17 F, 75 MP, 339/176 M, 176 MF, 176 MP, 278 C

[56] References Cited

U.S. PATENT DOCUMENTS

| | | | |
|---|---|---|---|
| 2,476,886 | 7/1949 | Miller et al. | 339/278 C |
| 3,233,211 | 2/1966 | Smith | 339/278 C |
| 3,638,166 | 1/1972 | Steipe | 339/278 C |
| 4,080,027 | 3/1978 | Benasutti | 339/75 MP |

*Primary Examiner*—Joseph H. McGlynn

*Attorney, Agent, or Firm*—Silverman, Cass, Singer & Winburn, Ltd.

[57] ABSTRACT

An electric contact comprising a first conductive metal layer on a surface of a plastic layer and a second springiness metal layer on the opposite side of the plastic layer. The first and second metal layers consist of a plurality of metal stripes in parallel with each other in alignment with each other, respectively. Terminal elements of the metal stripes comprises on one sides or on both sides thereof wire positioning walls to facilitate soldering of wires to the terminal elements. By foldering portions of the terminal elements so as to expose the conductive metal layers, the soldering of the wires to the terminal elements are further facilitated. Even if distances between the opposite metal stripes attached to a connector housing are not uniform, the multi contacts are uniformly in contact with each other when connectors are connected. By shifting the terminal elements of multi contacts away from each other keeping their parallelism but not aligned with each other in their longitudinal directions, the difficulty in soldering wires due to overlapping of the terminal elements is eliminated.

51 Claims, 131 Drawing Figures

FIG_10a FIG_10c FIG_10e
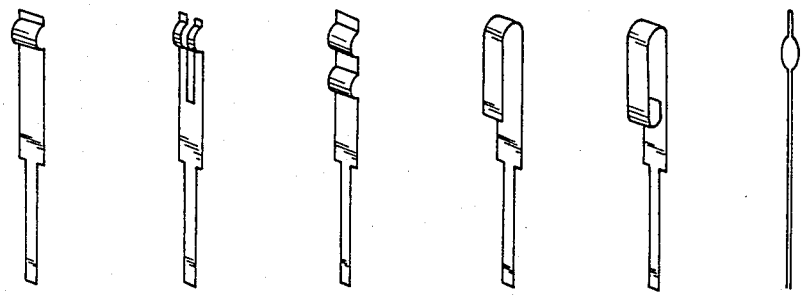
FIG_10b FIG_10d FIG_10f
FIG_11a FIG_11b FIG_11c
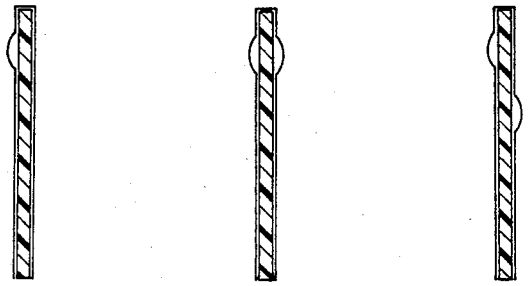

ELECTRIC CONTACTS AND ELECTRIC CONNECTORS

BACKGROUND OF THE INVENTION

This invention relates to electric contacts including single or multi contacts for connectors for use in relays, switches and the like, and more particularly to electric connectors comprising such single contacts or multi contacts.

Contacts for use in connectors, relays, switches and the like are required to have high conductivity and springiness in their nature. In general, however, metals having the higher conductivity exhibit the lower springiness, while metals having the higher springiness exhibit the lower conductivity. There has been no metal fulfilling the two requirements, that is, the high conductivity and springiness, simultaneously.

Therefore, copper alloys such as phosphor bronze are generally used, which fulfil the above requirements to a certain extent. However, even such a copper alloy, which is generally recognized to be most suitable for this purpose, has a much lower conductivity than that of pure copper and silver. In order to obtain contacts of high conductivity having the required springiness, therefore, high resilient metals should be used or sectional areas of the contacts should be made large to improve their conductivity, so that the contacts unavoidably become large. Accordingly, the miniaturization of contacts would encounter a limitation due to these factors. This limitation makes it difficult to realize connectors of small size and high performance which have been required to realize small-sized and high-performance electronic equipment.

Moreover, copper alloys to be used as spring materials are generally not only very expensive but also very troublesome in production processes, inasmuch as they need high accuracy heat treatment by precisely controlling temperature, time and atmosphere. Contacts made of such alloys are naturally expensive.

In order to eliminate the above disadvantages, it has been attempted to joint or laminate a high springiness metal and a high conductivity metal by pressure welding, electrolytic process or vapor deposition to obtain contacts having high conductivity and springiness. However, with these methods directly jointing the different metals, diffusion between them progresses step by step with the lapse of time to change compositions and conditions of the metals, so that the initial characteristics of the metals change so as to lower the performance of the contact. Moreover, the different kinds of metals tend to cause local batteries which would cause corrosion of the metals to lower their performance. Accordingly, it has been difficult to produce small-sized and high-performance contacts.

In prior art multi contacts connectors, moreover, single contacts 1 made of a copper alloy as above described are inserted into fixing apertures 2*a* of an insulating housing 2 and fixed thereat as shown in FIGS. 1*a* and 1*b*. In order to make smaller the connectors, when the number of the contacts per a constant distance is increased, intervals between the fixing apertures 2*a* become unavoidably smaller. Accordingly, it is limited in cost and material to make small the insulating housing. In fixing the single contacts inserted in the fixing apertures of an insulating housing, moreover, the more the number of the single contacts and the smaller the contacts, the more difficult is the assembling of the connector.

In order to avoid this difficulty, a method has been proposed in that a series of required plural contacts 1 whose ends are connected by a connecting piece 3 are made and are simultaneously inserted into fixing apertures of an insulating housing and thereafter the contacts are separated by cutting the connecting piece 3 along a line A as shown in FIG. 2. However, as a certain extent achievement of the miniaturization and high density application of the contacts to an insulating housing, the mechanical strength of the contacts is unavoidably lowered and intervals between the fixing apertures are minimized. As the result, in a step of transferring a series of contacts produced in a press to an assembling station, the intervals and positions of the contacts become irregular owing to their entanglement and deformation, so that the insertion of the contacts into the apertures becomes difficult making it impossible to assemble the connector with high productivity. Moreover, it is troublesome to cut off the connecting pieces 3 after insertion of the contacts.

As shown in a perspective view of FIG. 3*a*, it has been proposed to make multi contacts comprising a plastic layer 4, metal layers 5 of high conductivity and metal layers 6 of high springiness to form contacts 7 which are in the form of stripes arranged in rows with required intervals and have contact elements 7*a* and terminal elements 7*b*, respectively. In such multi contacts, the metal layers 6 of high springiness may be formed by a common single metal plate as shown in FIG. 3*b*. It is furthermore proposed to make multi contacts comprising a plastic layer 4 having a springiness and stripe contacts 7 formed on one surface of the plastic layer 4 in rows with required intervals as shown in FIG. 3*c*.

With these multi contacts, respective contacts 7 form a unitary body with the aid of the plastic layer 4. A common plastic layer 4 formed with two groups of multi contacts 8 and 9 as shown in FIG. 4*a* is folded such that metal layers 5 of high conductivity are on outer sides as shown in FIG. 4*b*, and thereafter the folded assembly is held by insulating blocks 10 and 21 as shown in a sectional view of FIG. 4*c* to form a male connector. A reference numeral 12 in FIG. 4*c* denotes extending contact elemets. Such a multi contact connector is therefore easily manufactured in comparison with a multi contact connector whose single contacts are inserted into apertures formed in an insulating block and fixed thereat. Moreover, by utilizing the etching method, a plurality of small contacts can be exactly formed with narrow intervals. Furthermore, these multi contacts comprise the separate metal layers exhibiting the high conductivity and springiness, so that they do not have the disadvantage in that sectional areas of the contact should be made large to improve their conductivity as contacts made of copper alloys which simultaneously fulfil the requirements of conductivity and springiness. Accordingly, small-sized multi contact connectors can be realized which have high connecting performance and other superior characteristics.

With such multi contacts, however, the metal layers are provided on a common flat plastic layer to form the contacts 7, so that their terminal elements are unavoidably flat. Such flat terminal elements do not determine positions of lead wires for other circuits. As the result, when the contacts 7 are arranged with narrow intervals, there is a risk of a lead wire 13 being soldered to a terminal element 7b at 14 to closely adjacent to a next lead wire as shown in FIG. 5a and there is a further risk of solder 14 extending over two terminal elements 7b to short-circuit therebetween. In order to avoid these risks, distances between the contacts must be enlarged, so that small-sized connectors cannot be accomplished.

With such multi contacts, moreover, the metal layers 5 for the springiness are generally made of a stainless steel alloy which is inferior in not only conductivity but also soldering capability. In a connector having contacts whose terminal elements 24b are inserted in apertures 26a formed in a printed circuit board 26 and connected to conductive elements 26b by means of molten solder bath method, therefore, the molten solder 27 tends to concentrate on a side of the metal layers 22 of conductivity, so that the solder 27 does not extend uniformly about terminal elements 24b of the contacts. As the result, the amount of the solder to be attached would become insufficient and cause defective soldering. Moreover, when a mating connector is removed from the connector fixed to the printed circuit board, the soldered portions of the terminal elements 24b are prone to failure owing to forces acting upon the soldered portions, whereby the connections tend to become incomplete. Accordingly, a connector superior in connection cannot be realized.

In order to solve this problem, it is considered that the terminal elements 24b are coated with metal layers by plating, such as tin, copper, silver or gold or alloys including these metals which are superior in soldering capability or pins 22' having circular or square cross-sections are fixed to the metal layers 22 of conductivity of the terminal elements 24b as shown in FIG. 7. However, when these are carried out, separate steps are necessary to make complicated the manufacturing processes.

SUMMARY OF THE INVENTION

It is a primary object of the invention to provide an improved electric contact and multi contacts which eliminate all the disadvantages of the prior art.

In order to achieve this object, an electric contact according to the invention comprises a first metal layer for providing a conductivity, a second metal layer for providing a springiness and a plastic layer as an insulator, these layers forming a unitary laminated contact.

According to the invention, two first metal layers are provided as the outermost layers between which is provided a second metal layer separated from said first metal layers by respective plastic layers to form two contacts integrally formed back to back.

It is another object of the invention to provide improved multi contacts which have high contacting performance and are small-sized and easy to manufacture.

In order to accomplish this object, according to the invention, said first metal layer consists of a plurality of metal stripes in parallel with each other and said second metal layer consists of a plurality of metal stripes which are located aligned with the first mentioned metal stripes said plastic layer interposed between said first and second metal layers.

It is a further object of the invention to provide multi contacts comprising wire positioning walls to eliminate any short-circuit between contacts, thereby contribute to produce small-sized multi contact connectors and relays so as to realize small-sized electric equipment.

According to the invention, for this object, said first metal layer consists of a plurality of metal stripes in parallel with each other and plastic parts of substantially rectangular shapes of said plastic layer at least on one side of terminal elements of said metal stripes are cut along three sides of said rectangular shapes and raised at right angles along remaining sides to form wire positioning walls substantially at right angles to said terminal elements.

According to the invention, said first metal layer consists of a plurality of metal stripes in parallel with each other and said plastic layer is formed between terminal elements of said metal stripes with wire positioning wall apertures through which snugly extend wire positioning walls formed on a wire positioning wall forming plate attached to said unitary laminated contact on an opposite side of said metal stripes.

In preferred embodiment of the invention, said first metal layer consists of a plurality of metal stripes in parallel with each other and plastic parts of substantially rectangular shapes of said plastic layer at least on one side of terminal elements of said metal stripes are cut along three sides of said rectangular shapes and raised at right angles along remaining sides to form wire positioning walls substantially at right angles to said terminal elements and at the same time wire positioning wall apertures as the result of the cutting and raising the wire positioning walls, through which separate wire positioning walls formed on a wire positioning wall forming plate attached to the contact extend to form wire positioning walls in conjunction with the first mentioned wire positioning walls on both sides of the terminal elements.

It is an object of the invention to provide an improved single contact and multi contacts which are easy to be soldered to wires.

In order to achieve this object, a metal layer made of the same material as said first metal layer is provided on said second metal layer on opposite side of said first metal layer.

According to the invention, said first metal layer consists of a plurality of metal stripes whose terminal elements extend along and fold along lines substantially perpendicular to lengthwise directions of the terminal elements to expose the first metal layer. In other embodiments, the terminal elements are formed with projections extending at least one sides of the terminal elements which are folded to expose the first metal layer.

It is a further object of the invention to provide improved multi contacts which are uniformly in contact with each other even if distances between opposite metal stripes of a female connector are not equal due to incorrectness in parallelism in soldering the layers or setting them in an insulating housing of a connector.

In order to achieve this object, according to the invention, said first metal layer consists of a plurality of metal stripes in parallel with each other, and at least parts of said plastic layer among said plastic layer and said second metal layer are removed to connect said metal only by the proximities of terminal elements of said metal stripes.

It is an object of the invention to provide improved multi contacts which eliminate difficulty in soldering wires due to overlapping of terminal elements of the multi contacts.

In order to accomplish this object, according to the invention said first metal layer consists of a plurality of metal stripes in parallel with each other to form two groups of multi contacts on a same insulating plate for use in a multi contact connector, and terminal elements of said metal stripes are shifted away from each other keeping their parallel relations but are not aligned with each other in their longitudinal directions when they are arranged in a housing of a connector.

It is a further object of the invention to provide an electric connector including multi contacts, which are small-sized and superior in connection to contribute to produce small-sized electric equipment.

According to the invention, a contact consists of a conductive metal layer on one surface of a dielectric layer and a springiness metal layer on the opposite surface of the dielectric layer.

In this manner, an electrostatic capacity between both the metal layers and an increased inductance of the contact if using a magnetic substance form a low-pass filter with wires connected to the connector, thereby removing high frequency components due to electromagnetic wave fault to eliminate noises from transmitted signals so as to greatly contribute decrease of error bits in data transmission. Therefore, a great effective connector can be obtained which is inexpensive and simple in construction in which all contacts are formed in laminated plates.

The invention will be more fully understood by referring to the following detailed specification and claims taken in connection with the appended drawings.

BRIEF DESCRIPTION OF THE DRAWINGS

FIGS. 10*a*–10*f* illustrate other configurations of single contacts;

FIGS. 11*a*–11*c* illustrate contacts according to the invention each consisting of a folded metal layer between which an insulator is interposed;

DETAILED DESCRIPTION OF THE PREFERRED EMBODIMENT

Figure 8:
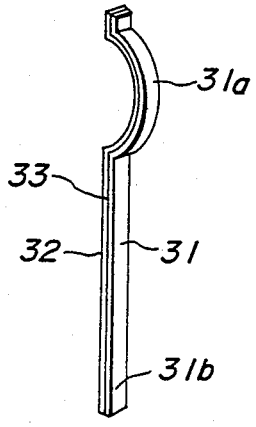
FIG. 8 is a perspective view of a single contact according to the invention.

FIG. 8 illustrates one embodiment of a single contact according to the invention. This contact essentially comprises a first metal layer 31 having a desired conductivity for forming a contact element 31*a* and a terminal element 31*b* and a second metal layer 32 having a required springiness selected from the existing metals and a plastic layer 33 interposed therebetween for supporting the two laminated metal layers 31 and 32 one above the other. This composite contact is produced in the following manner.

Figure 9A:
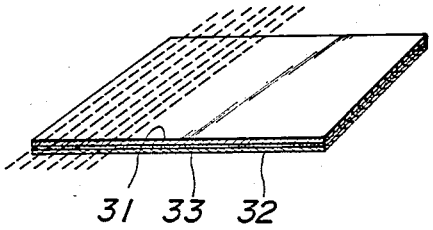
FIGS. 9*a* and 9*b* are perspective views for explaining a producing method of the contact shown in FIG. 8.
Figure 9B:
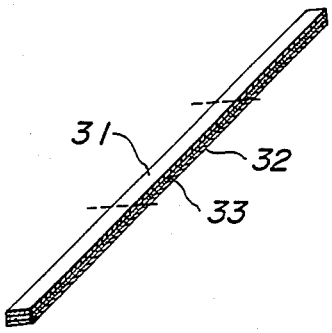

One metal having a required conductivity for forming the first metal layer 31 is selected from a group of the existing metals such as copper, silver, gold, aluminum and the like and alloys of these metals. Then, one metal having a required spring force for forming the second metal layer 32 is selected from a group of the existing metals such as iron alloys as spring stainless steel, copper alloys as spring beryllium-copper alloy, a metal containing spring reinforcing agent such as whisker and the like, amorphous metal and the like. The metal for the second metal layer may be preferably selected from iron, copper, cobalt, titanium, zirconium and nickel base alloys. These metals are formed in plates, stripes or foils in required thicknesses according to manufacturing method, spring force, shapes of the contact to be made and the like. On the other hand, a plastic material is selected for the plastic layer 33 from epoxy, polyester, polyimide, polyamide or polyolefin resin and the like. The plastic material may be preferably selected from a group of phenol, amino, epoxide, furan, polyether, allyl, polyimide, polyamide, polyester, polycarbonic ester, polyphenylene sulfide, polyolefin, vinyl and silicone resins. The plastic material is formed in a plate, stripe or the like having a desired thickness corresponding to those of the first and second metal layers 31 and 32. Then the plastic layer 33 is coated with a thermoplastic or heat bonding adhesive. The coated plastic layer 33 is sandwiched between the first and second metal layers 31 and 32 and heated and pressed to form a plate or stripe as shown in FIG. 9*a* or 9*b*. The plate thus formed is then cut along dotted lines while it is being bent into desired contact shapes as shown in FIG. 9*a*. The stripe is cut at dotted lines, while it is being bent. FIG. 10 illustrates various contacts (*a*)-(*f*) formed in these manner. As shown in FIGS. 11 (*a*)-(*c*), a plate or stripe may be folded or doubled, between which an insulating material is inserted to form a contact.

As an alternative, the plastic layer 33 may be formed on both surfaces with the first and second metal layers 31 and 32 by means of electroplating, vapor deposition or spattering to form the plate or stripe as shown in FIG. 9*a* or 9*b*.

Moreover, the adhesive may be applied onto either both the surfaces or one surface of the plastic layer or partially applied to the surface or surfaces of the plastic layer. The metal layers may be simply arranged on the plastic layer without using any adhesive. As an alternative, an adhesive is applied to a surface of a metal layer or between two metal layers, so that the adhesive layer may be used as an insulating layer without using a plastic layer.

In this manner, the present invention takes a step out of the prior art attempted to do inherently impossible matter, that is, to make a single body fulfil both the conductivity and springiness. According to the invention, there are provided the first metal layer 31 taking charge of the conductivity and the second metal layer 32 taking charge of the springiness to effectively utilize the respective characteristics without compromising both the conductivity and springiness.

According to the invention, therefore, the conductivity and springiness of contacts can be easily improved, so that contacts superior in connection can be obtained which are smaller than those of the prior art. Moreover, the first and second metal layers 31 and 32 may be made of metals inexpensive in comparison with expensive copper alloys. As the plastic layer 33 is also inexpensive, the contact according to the invention is inexpensive.

Moreover, according to the invention between the first and second metal layers 31 and 32 is securely held by means of advanced adhesion technique the plastic layer 33 to which required insulating or conductive property and desired pliability or flexibility can be easily given in manufacture according to use conditions, thereby eliminating the disadvantages in two directly contacted metals of the prior art. According to the invention, therefore, there is no risk of damage of contacts due to separation of metals because the pliability of the plastic material absorbs the strains due to difference in coefficient of thermal expansion of the two metals and due to difference in elongation caused by bending in forming and using the contacts. Furthermore, if the plastic layer 33 having insulating property is used, the two metal layers 31 and 32 are electrically insulated from each other to prevent a local cell or battery caused by the difference in electric potential between two metals, thereby preventing the disintegration due to electrochemical corrosion.

Figure 12A:
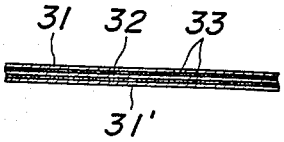
FIGS. 12*a* and 12*b* illustrate modification of contact according to the invention.
Figure 12B:
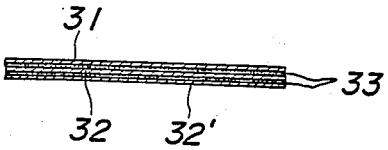

As an alternation, a first metal layer 31 is divided into two layers 31 and 31' between which is provided a second metal layer 32 separated therefrom by plastic layers 33 to form two contacts integrally formed back to back as shown in FIG. 12*a*. This contact is useful, for example, as a relay contact whose both surfaces are in contact with conductors. Moreover, two second metal layers 32 and 32' may be provided in order to improve the springiness as shown in FIG. 12*b*.

As an alternative, moreover, a copper foil and a stainless steel foil are attached to each other by means of an adhesive, for example, a heat-adherent plastic adhesive without using a plastic layer, or a second metal layer is coated with a plastic and a first metal layer is formed on the other surface of the second metal layer by means of metal vapor depositing method or ion plating method.

In order to improve the environment-resistance and wear-resistance, stability of electric connection, weldability or solderability to terminal elements, contacts may be subjected to, for example, nickel or gold plating or chemical treatment as oxidization, or may be provided on required portions with coating layers of an oil, various kinds of paints or coating agents.

Figure 13A:
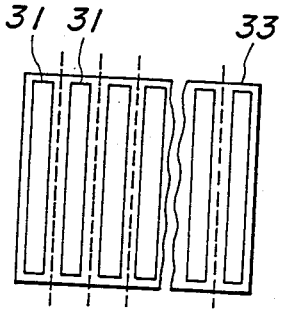
FIGS. 13*a*–13*d* illustrate other embodiments of contacts according to the invention.
Figure 13B:
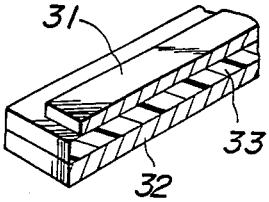
Figure 14:
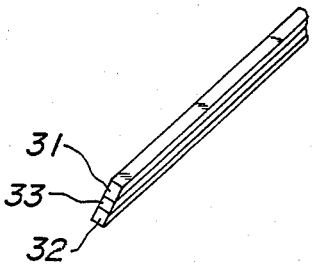
FIG. 14 shows a further embodiments of a contact according to the invention.
Figure 13C:
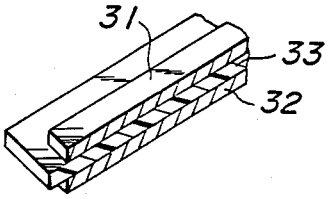
Figure 13D:
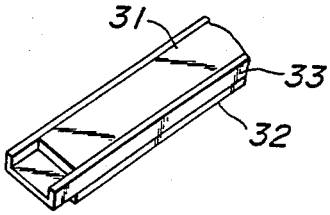

When the plate or stripe lamination shown in FIG. 9*a* is cut to form single contacts, burrs often occur at the cut surfaces. The burrs may electrically connect the first and second metal layers to form local batteries of the different metals which would cause corrosion resulting in decay of the contact. In order to avoid this, conductive metal layers 31 and/or second metal layers 32 are provided in the form of separate lands which are then cut off along dotted lines as shown in FIG. 13*a* into contacts each having a plastic layer 33 therearound. In this manner, the first and second metal layers are sufficiently separated by the plastic layers as shown in FIGS. 13*b* and 13*c*. As an alternative, ends of the plastic layer 33 may be bent as shown in FIG. 13*d*. Moreover, when stripes are cut to form contacts, they may be obliquely cut as shown in FIG. 14.

Figure 15A:
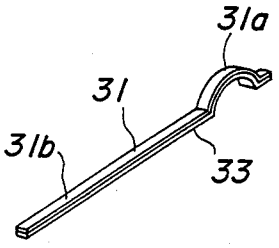
FIG. 15*a* is a perspective view of another single contact according to the invention.
Figure 15B:
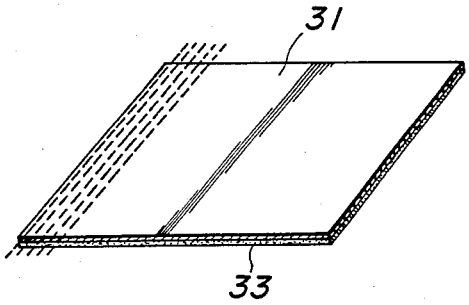
FIG. 15*b* illustrates a further embodiment of a contact according to the invention.

In one embodiment of the invention, a contact comprises two layers, that is, a metal layer 31 having a contact element 31*a* and a terminal element 31*b* and a plastic layer 33 as shown in FIGS. 15*a* and 15*b*. The metal layer 31 is made of a metal having a conductivity and a springiness such as phosphor bronze, brass, beryllium-copper alloy and the like, iron alloys as stainless steel, spring metal containing a spring reinforcing agent such as whisker and amorphous metal causing contact pressures and metals having high conductivity such as copper, silver, gold and the like. The plastic layer 33 is made of an insulating material and as epoxy, polyester, polyimide, polyamide, polyolefin, rubber and the like in a single layer or two or more layers. One of these plastic materials may include one or more nonmetals such as ceramics and carbon or one or more compounds in the form of whisker, fiber and foil, thereby remarkably improving the springiness of the plastic layer. Moreover, the plastic layer may have the conductivity. A plastic layer having a springiness may be applied to a metal layer made of a copper alloy having a conductivity and a springiness. A metal layer having a high conductivity but no springiness may be applied to a conductive or insulating plastic layer having a springiness, or a metal layer having a high springiness may be applied to a conductive or insulating plastic layer having no springiness. In this manner, the properties of the metal and plastic layers may be selected according to requred conditions. Thus formed metal layer or plastic layer is coated with a thermoplastic or heat-adherent adhesive and is pressed while heating, or bonded by a rubber adhesive or polymerization setting adhesive. A metal layer may be coated with a flowable plastic material by spraying or printing or a metal layer heated at temperatures higher than a melting point of a plastic material is arranged in a flowing atmosphere in which plastic particles are floating to make the plastic material attach to the metal layer. A metal layer may be formed on a plastic layer by means of electroplating, chemicalplating, spattering, ionplating or the like.

Figure 16A:
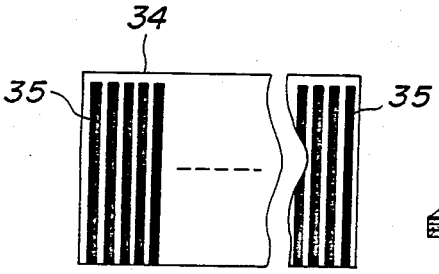
FIGS. 16*a*–16*c* illustrate multi contacts according to the invention.
Figure 16B:
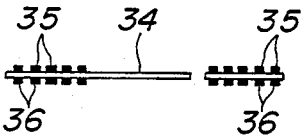
Figure 16C:
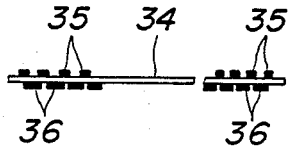

In a further embodiment of the invention, on both surfaces of a plastic layer 34 are formed with first and second metal layers 35 and 36 in the form of stripes in parallel with each other with required intervals to form a required number of contacts, that is, multi contacts as shown in FIGS. 16*a* and 16*b*. As an alternative, second metal layers 36 are formed on a surface of a plastic layer 34 opposite to the surface formed with first metal layers 35, such that each second metal layer 36 extends partially over the two adjacent first metal layers 35. For example, the first metal layers 35 are conductive and the second metal layers 36 are of springiness to form multi contacts as shown in FIG. 16*c*. These are made in the following manner.

Figure 17:
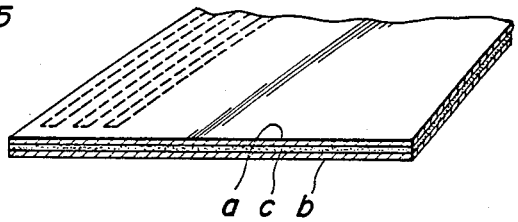
FIG. 17 is a perspective view for explaining a production process of the contacts shown in FIGS. 16*a*–16*c;*

A first metal plate a is made of a metal such as copper, silver, gold or alloys thereof to have a required conductivity as shown in FIG. 17. On the other hand, a second metal plate b is made of a metal such as spring stainless steel, spring beryllium-copper alloy, a metal containing spring reinforcing agent such as whisker and the like to have a required springiness. The first and second metal plates are attached with an adhesive to a plastic plate c made of epoxy, polyester, polyimide or the like. The first and second metal plates are then etched so as to remove unnecessary portions thereof to form the metal layers 35 and 36, thereby obtaining multi contacts as shown in FIGS. 16*a* and 16*b*. The first and second metal layers 35 and 36 may be formed on the plastic layer 34 by means of electroplating, chemicalplating, vapor deposition, spattering or the like.

Figure 18:
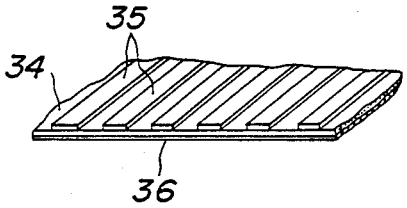
FIG. 18 is a perspective view of another embodiment of the multi contacts according to the invention.

In the above embodiment, the first metal layer 35 of conductivity and the second metal layer 36 of springiness are etched to form a number of contacts. As an alternative, as shown in FIG. 18, only the first metal layer 35 is etched to form contacts and the second metal layer 36 is provided common to the contacts on a surface of the plastic layer 34 opposite to the contacts.

As described in the first embodiment, with the multi contacts explained herein the conductivity and springiness thereof can be easily improved so that contacts superior in connection can be obtained which are smaller than those of the prior art. The multi contacts thus produced are inexpensive and durable without causing local batteries between the different metals.

Figure 19A:
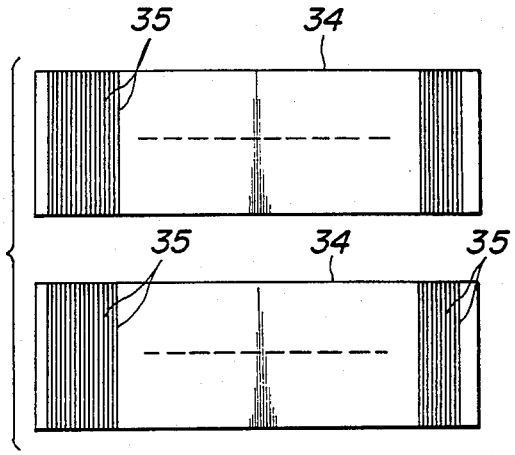
FIGS. 19*a*–19*d* are views for explaining connectors using the multi contacts according to the invention.
Figure 19C:
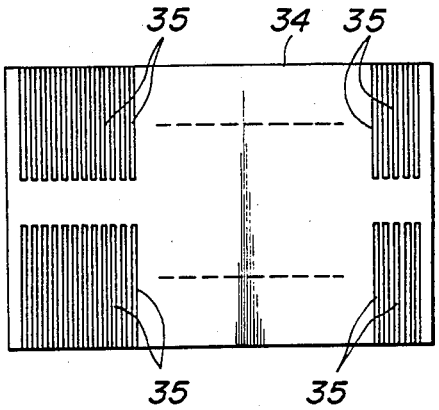
Figure 19B:
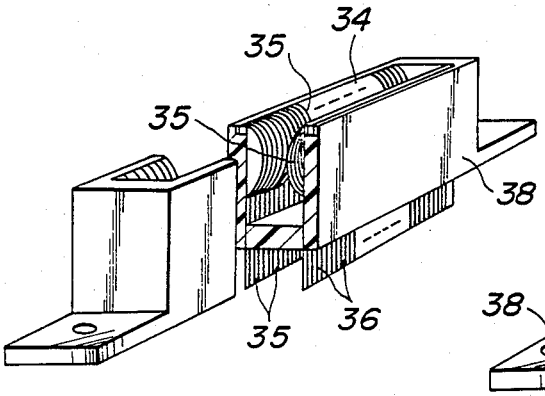

According to the invention, etching and vapor deposition can be used which are enable to obtain articles with high accuracy in dimension. Accordingly, contacts having small widths can be exactly formed with small intervals, so that multi contacts can be small-sized. As the multi contacts are integrally connected by a plastic layer to prevent irregularities in intervals between contacts and inaccuracy in positions in longitudinal directions of the contacts. As shown in FIG. 19*a*, therefore, two multi contacts formed with the first and second metal layers 35 and 36 are fixed to an inside of an insulating housing 38 such that the first metal layers 35 are in opposition to each other as shown in FIG. 19*b*, so that a multi female connector is simply constructed. On the other hand, metal layers 35 as shown in FIG. 19*c* are folded back to back and inserted into a female connector and fixed thereat in a manner enabling female and male contacts to be in contact with each other when the male and female connectors are connected, thereby simply obtaining a small type multi contact male connector.

Figure 20:
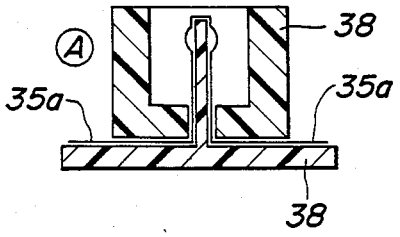
FIGS. 20–30 are sectional views illustrating connectors according to the invention.
Figure 21A:
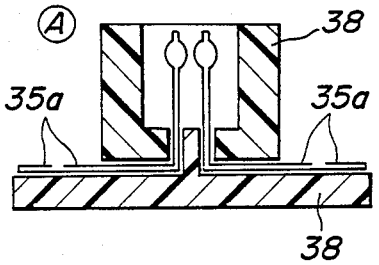
Figure 21B:
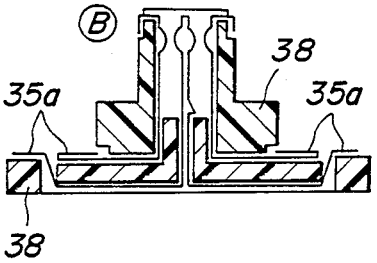

Multi contact connectors having various contact elements and terminal elements can be formed in the same manner as above described. FIG. 20 illustrates a male connector A wherein contacts or metal layers 35 having contact elements and terminal elements are fixed to insulator blocks 38 such that their terminal elements 35*a* are located in horizontal directions, to which are soldered lead wires. FIGS. 21*a* and 21*b* illustrate a male connector A and a female connector B.

Figure 22A:
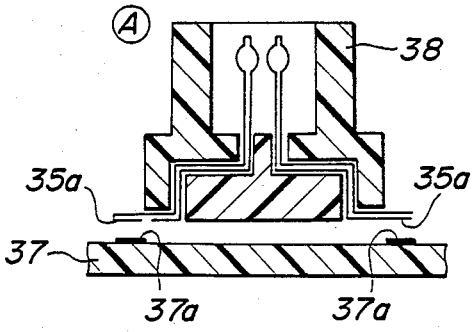
Figure 22B:
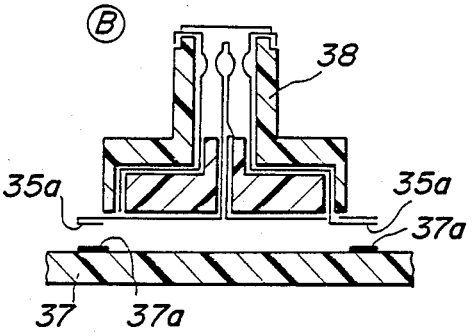
Figure 23A:
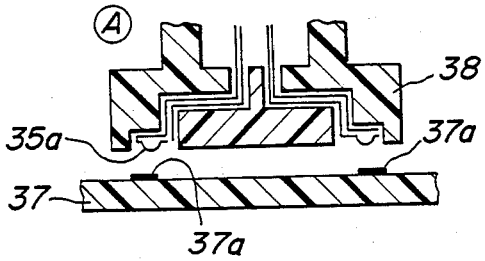
Figure 23B:
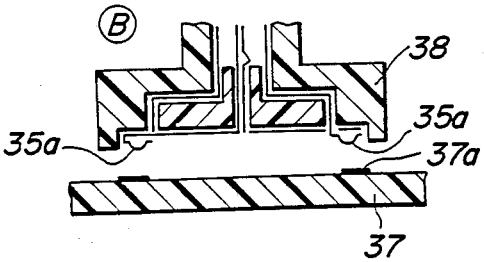

FIGS. 22*a* and 22*b* illustrate male and female connectors A and B whose terminal elements 35*a* are connected to conductors 37*a* on printed circuit boards 37 by soldering. In FIGS. 23*a* and 23*b*, wherein contact elements are not shown, terminal elements 35*a* are bent in semicircular shapes to which conductors 37*a* are pressed to complete circuits.

Figure 24A:
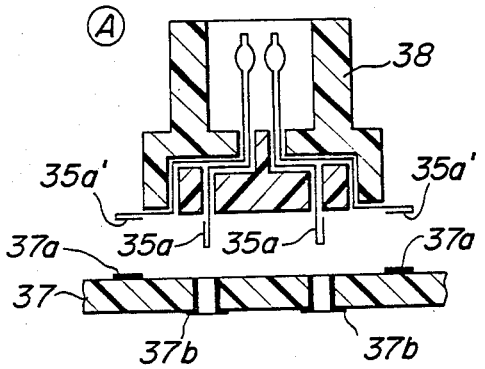
Figure 24B:
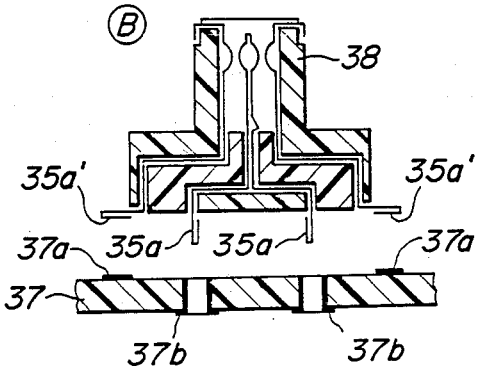
Figure 25A:
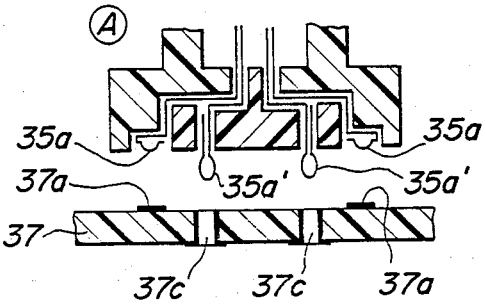
Figure 25B:
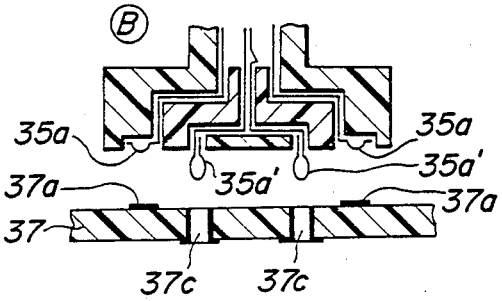

In FIGS. 24*a* and 24*b*, terminal elements 35*a* of male and female connectors A and B are inserted in dip soldering apertures 37*b* of printed circuit boards and connected thereto by soldering and the remaining terminal elements 35*a*′ are soldered to or urged against the conductors 37*a*. In FIGS. 25*a* and 25*b* (contact elements are not shown), terminal elements 35*a* are bent in circular shapes adapted to urged against conductors 37*a* of printed circuit boards 37 and the remaining terminal elements 35*a*′ are provided with looped portions which are forced into metal coated apertures 37*c* of the printed circuit boards 37 to complete the circuit.

Figure 26A:
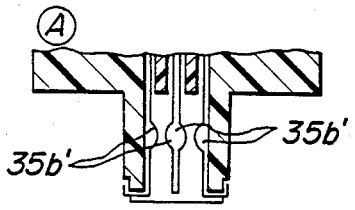
Figure 27A:
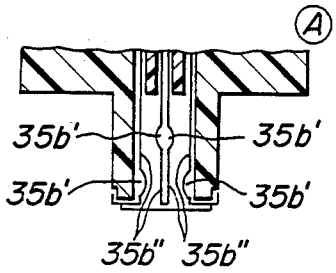
Figure 26B:
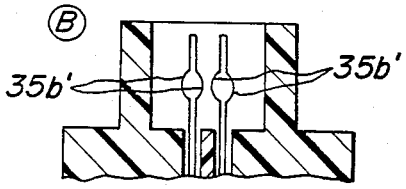
Figure 27B:
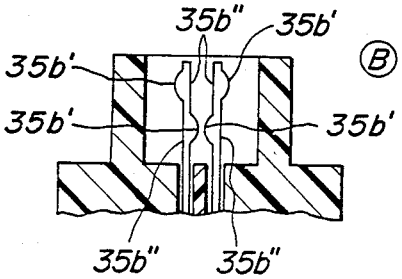
Figure 28A:
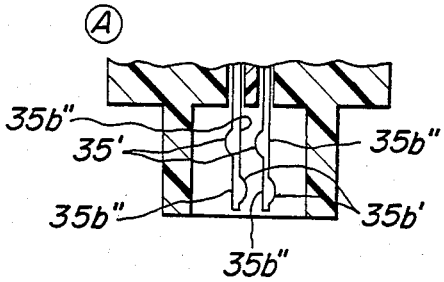
Figure 29A:
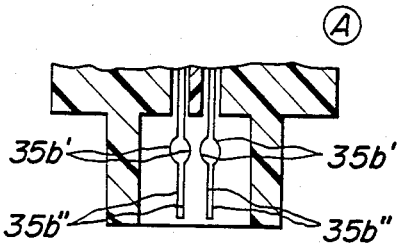
Figure 28B:
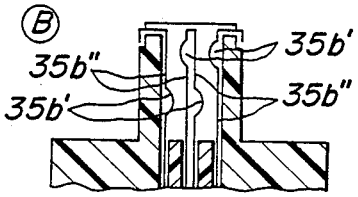
Figure 29B:
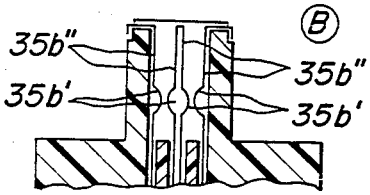
Figure 30:
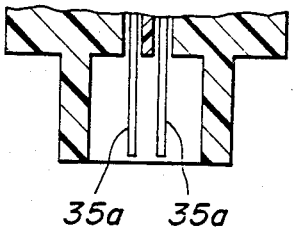

Modified contact elements of male and female connectors A and B are shown in FIGS. 26*a* and 26*b*, 27*a* and 27*b*, 28*a* and 28*b*, and 29*a* and 29*b*. In FIGS. 26*a* and 26*b*, expanded or looped portions 35*b*′ on male and female contact elements are adapted to contact each other at those portions. In the embodiments shown in FIGS. 27*a*–29*b*, expanded portions 35*b*′ on male and female contact elements are adapted to contact flat portions 35*b*″ of mating contact elements. FIG. 30 illustrates flat contact elements 35*a* which are adapted to contact expanded portions of mating contact elements (not shown).

Figure 31:
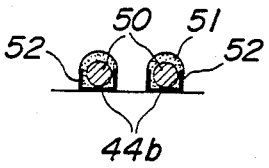
FIG. 31 is a sectional view for explaining a prevention of defect of soldering.

In a further preferred embodiment of the invention, as shown in FIG. 31 there are provided wire positioning walls 52 on both sides of terminal elements to prevent any short-circuit between adjacent terminal elements, thereby realizing small-sized multi contact connectors and relays to achieve small-sized electric equipment provided with these connectors or relays.

Figure 32A:
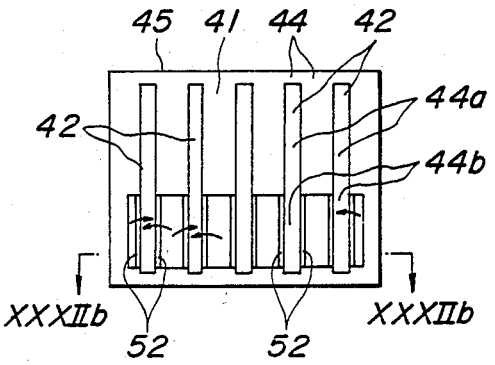
FIGS. 32*a* and 32*b* illustrate one embodiment of multi contacts according to the invention.
Figure 32B:
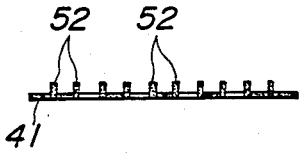

Referrring to FIGS. 32*a* and 32*b*, parts of a plastic layer 41 between terminal elements 44*b* are cut and raised onto the side of conductive metal layers 42 as shown by arrows to form wire positioning walls 52 substantially perpendicular to the terminal elements 44*b*. Parts of the plastic layer 41 on outer sides of the outermost terminal elements 44*b* are of course cut and raised simultaneously. Each plastic part is substantially rectangular in shape whose three sides are cut and along a remaining side the plastic part is raised or folded at right angles to the terminal element. A length of the wire positioning walls 52 along the terminal elements 44*b* is determined by a length required to solder wires to be connected. A height of the wire positioning walls 52 is also determined in consideration of diameters of the wires to be connected.

Figure 5A:
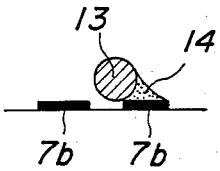
FIG 5a PRIOR ART
FIGS. 5*a* and 5*b* are schematic sectional view for explaining failures at connections of wires to flat terminal elements.
Figure 5B:
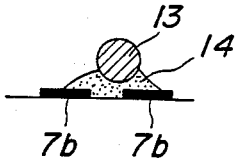
FIG 5b PRIOR ART
Figure 6:
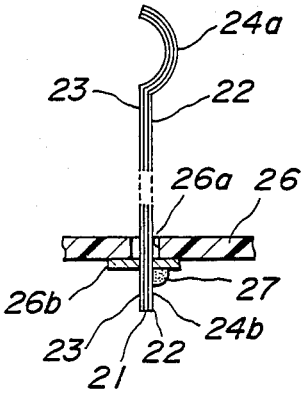
FIG 6 PRIOR ART
FIG. 6 is a sectional view for explaining failures at connections of a terminal element to a printed circuit board.
Figure 7:
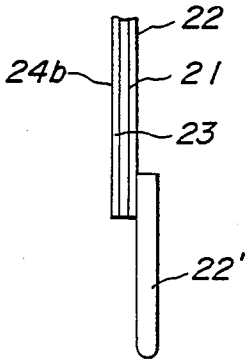
FIG 7 PRIOR ART
FIG. 7 is a side view of the connection which has been improved.

With such an arrangement, a wire located on a terminal element 44*b* is securely positioned by the wire positioning walls 52, and the solder is retained between the wire positioning walls 52 to prevent the deviation of the wire and the short-circuit between adjacent terminal elements caused by the solder extending therebetween as shown in FIGS. 5*a* and 5*b*.

Figure 33:
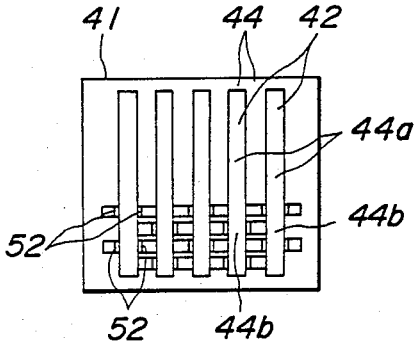
FIGS. 33–38 illustrate various embodiments of multi contacts according to the invention.
Figure 34:
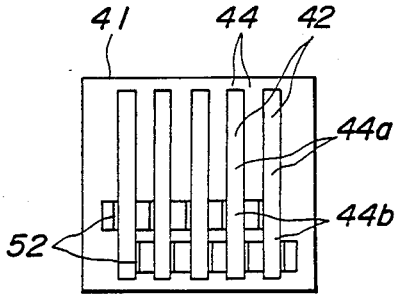

As shown in FIG. 33, parts of a plastic layer 41 may be cut and raised in plural rows and at every other terminal elements 44*b* alternately in adjacent rows to form substantially elongated wire positioning walls 52. As shown in FIG. 34, moreover, a plastic layer 41 may be cut and raised in two rows and on right sides of terminal elements 44*b* in one row and on left sides of terminal elements 44*b* in the other row. These embodiments shown in FIGS. 33 and 34 enable distances between contacts 44 to be shortened.

In general, a positioning wall of a plastic material formed by bending tends to return to its original position, so that with the construction comprising one metal layer and one plastic layer, the plastic portion is heated and bent so as not to return to its original position. With the construction comprising two metal layers and one plastic layer, the springiness metal layer bent together with the plastic portion prevents the plastic portion from returning to its original position.

Figure 35A:
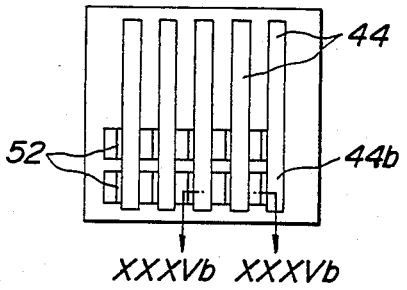
Figure 36:
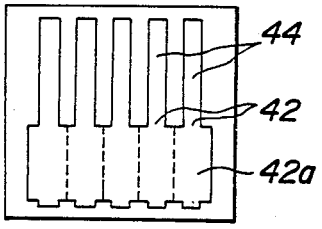
Figure 35B:
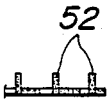
Figure 37:
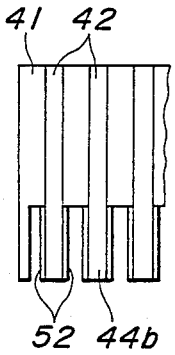
Figure 38:
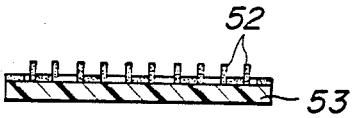

As an alternative, wire positioning walls 52 may be provided only on one sides of terminal elements as shown in FIGS. 35*a* and 35*b*. In this case, wires are caused to abut against the positioning walls 52 so as to position the wires and prevent solder from flowing to adjacent terminal elements. Moreover, as shown in FIG. 36, conductive metal layers are provided with projections 42*a* at both sides of terminal elements 44*b*. These projections 42*a* are cut along broken lines in FIG. 36 and raised to form wire positioning walls 52 continuous to the conductive metal layers to facilitate soldering. As a further alternative, plastic parts for positioning walls may be cut starting from edges of a plastic layer at ends of terminal elements 44*b* without leaving parts of the plastic layer 41 at the ends of the terminal elements 44*b* as shown in FIG. 37. In this case, if there is a risk of decrease in strength of the terminal elements 44*b*, an insulating plate 53 may be bonded to the plastic layer on opposite side to the wire positioning walls 52 as shown in FIG. 38.

Figure 39A:
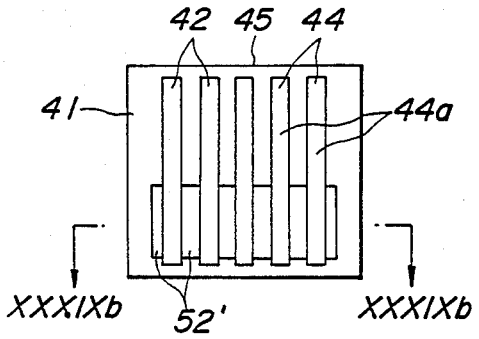
FIGS. 39–42 illustrate further embodiments of multi contacts according to the invention.
Figure 39B:
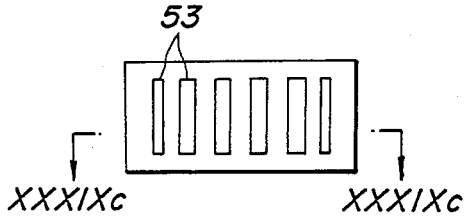
Figure 39C:
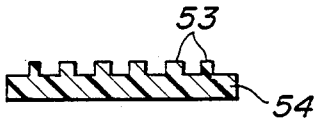
Figure 39D:
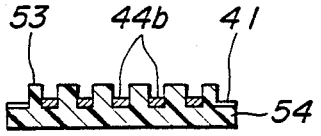

In a further embodiment, as shown in FIG. 39*a*, a plastic layer 41 of multi contacts is formed with wire positioning wall apertures 52' between terminal elements 44*b* and on outer sides of the outermost terminal elements 44*b*. On the other hand, as shown in FIGS. 39*b* and 39*c*, there is provided a wire positioning wall forming plate 54 made of a plastic or the like and having wire positioning walls 53 adapted to snugly fit in the wire positioning wall apertures 52' formed in the multi contacts shown in FIG. 39*a*. The wire positioning wall forming plate 54 is then bonded to the multi contacts 45 such that the wire positioning walls 53 of the plate 54 are fitted in the wire positioning wall apertures 52' of the multi contacts.

Figure 40:
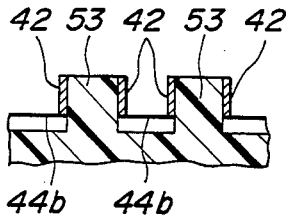
Figure 41A:
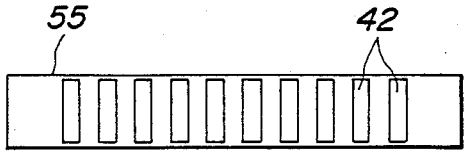
Figure 41C:
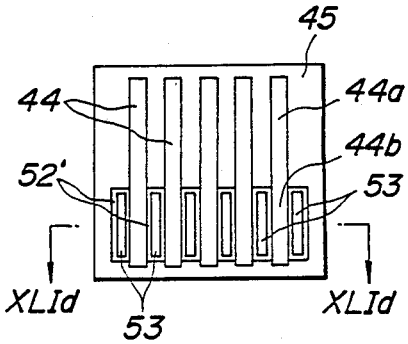
Figure 41B:
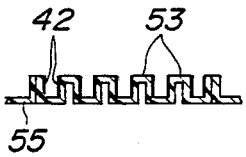
Figure 41D:
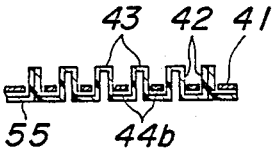
Figure 42:
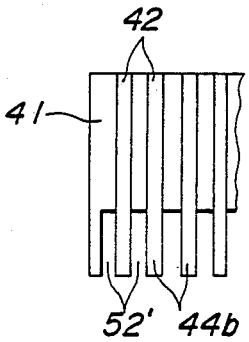

As shown in FIG. 40, conductive metal layers 42 may be provided on surfaces of the wire positioning walls 53 except upper surfaces of the walls and bottom surfaces between the positioning walls 53. In case of the structure comprising two metal layers and one plastic layer, the springiness metal stripes are of course insulatingly separated from each other to avoid short-circuit with the conductive metal layer when they are in the condition as shown in FIG. 40. Moreover, on an insulating forming plate 55 may be provided conductive metal layers 42 with intervals which make it possible to assemble the plate 55 as shown in FIGS. 41*c* and 41*d*. The insulating forming plate 55 is then bent such that the adjacent conductive metal layers are in opposition to each other to form positioning walls 53 as shown in FIG. 41*b*. The positioning walls 53 are inserted into wire positioning wall apertures 52' of multi contacts. This method is easy to form the conductive metal wires 42 in comparison with those shown in FIG. 40. Moreover, a plastic layer 41 may be cut at 52' starting from the proximity of ends of terminal elements 44*b* without leaving parts of the plastic layer 41 at the ends of the terminal elements 44*b* as shown in FIG. 42. In this case, a wire positioning wall forming plate (not shown) serves to reinforce the strength of the terminal elements 44*b* which has been weakened by the apertures 52' of the plastic layer 41. The wire positioning wall forming plate is somewhat different in position of wire positioning walls from those in the plate 54 shown in FIG. 39*c*.

In a slight modification of the above embodiments, as shown in FIGS. 43*a*–43*f*, parts of a plastic layer 41 on left sides of terminal elements 44*b* are cut and raised onto conductive metal layer sides substantially at right angles to the plastic layer 41 to form wire positioning walls 52 and wire positioning wall apertures 52'. The plastic layer 41 is further formed with a wire positioning wall aperture 58 on the right side of the terminal element 44*b* at the right end and having a length somewhat longer than those of the wire positioning walls 52 and a width substantially corresponding to a distance between the terminal elements 44*b*.

Figure 43A:
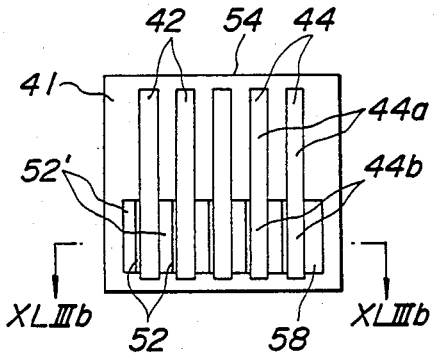
FIGS. 43–46 illustrate various embodiments of multi contacts according to the invention.
Figure 43C:
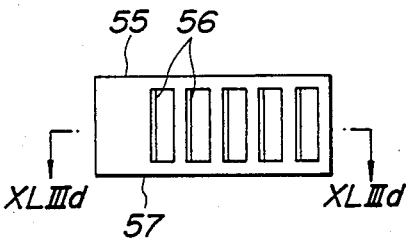
Figure 43D:
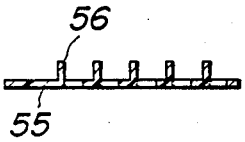

As shown in FIGS. 43*c* and 43*d*, on the other hand, parts of a plastic plate 55 are cut and raised to form a wire positioning wall forming plate 57 having wire positioning walls 56 with intervals such that the walls 56 are located on right sides of the terminal elements. The wire positioning walls 56 correspond in number to the terminal elements and have heights higher than those of the wire positioning walls 52 by thicknesses of the plastic plate 41 and lengths somewhat shorter than those of the wire positioning walls 52. The wire positioning wall forming plate 57 is bonded to the plastic plate by an adhesive such that the wire positioning walls 56 are located on the right sides of the terminal elements of the multi contacts 54 in the wire positioning wall apertures 52' as shown in FIGS. 43*e* and 43*f*.

Figure 43B:
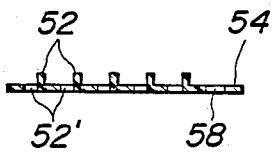
Figure 43E:
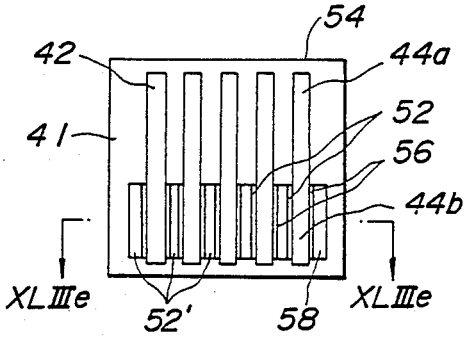
Figure 44A:
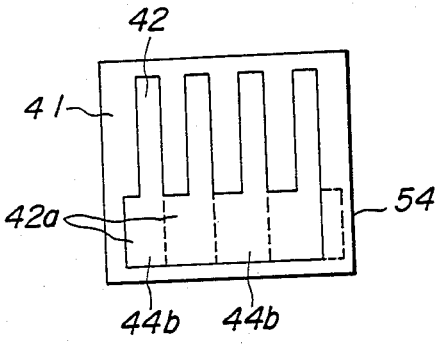
Figure 44C:
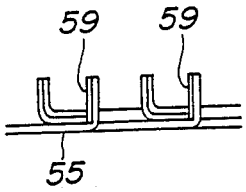
Figure 44B:
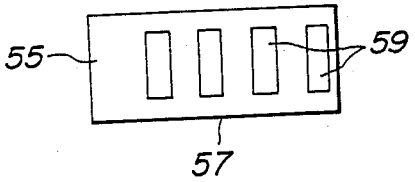

As an alternative, conductive metal layers 42 are provided on their left sides as viewed in FIG. 44*a* with projections 42*a* which are raised to form wire positioning walls 52 substantially in the same manner as in FIGS. 43*a* and 43*b*. As shown in FIG. 44*b*, on the other hand, conductive metal layers 59 are formed on a plastic plate 55 at locations to be cut and raised to form wire positioning wall forming plate 57 having wire positioning walls 56. In this case, the wire positioning walls 56 having therein metal layers are located on both sides of terminal elements.

Figure 43F:
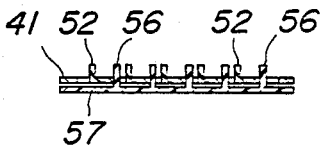

In the above embodiment, in case of the structure comprising two metal layers and one plastic layer, the springiness metal stripes are of course insulatingly separated from each other to avoid short-circuit with the conductive metal layer when they are in the condition shown in FIG. 43*f*. In case of the structure comprising one metal layer and one plastic layer, the plastic portion is heated and bent so as not to return to its original position.

Figure 1A:
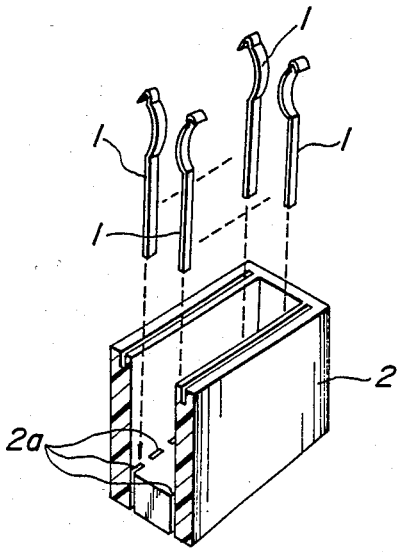
FIG. 1a PRIOR ART
FIG. 1*a* is a perspective view of a multi contact connector of the prior art for explaining manufacturing processes.
Figure 1B:
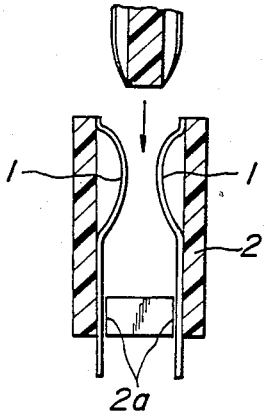
FIG. 1b PRIOR ART
FIG. 1*b* is a sectional view of the connector shown in FIG. 1*a;*
Figure 2:
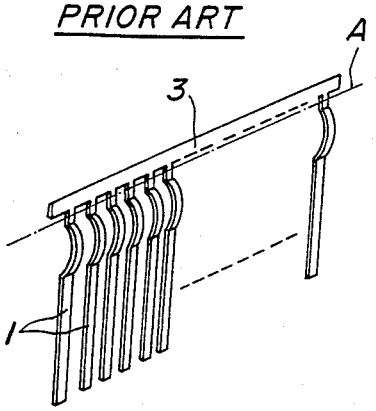
FIG. 2 PRIOR ART
FIG. 2 illustrates contacts for use in the connector shown in FIG. 1*a;*
Figure 3A:
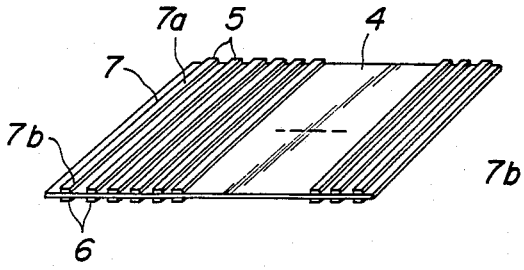
FIGS. 3*a*–3*c* are perspective view of multi contacts for explaining the improvement of the invention.
Figure 3C:
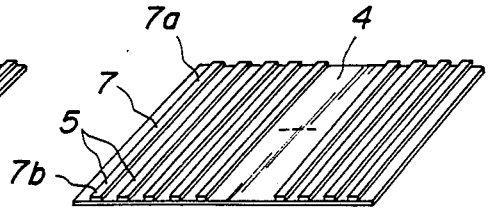
Figure 3B:
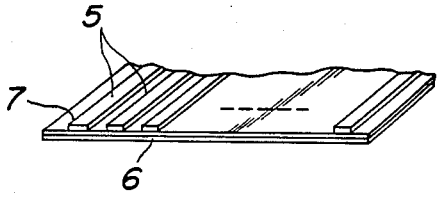
Figure 4A:
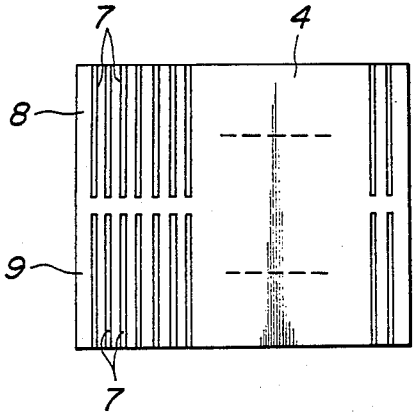
FIGS. 4*a*–4*c* are a plan, sectional and perspective views for explaining a multi contact connector for explaining the improvement of the invention.
Figure 4C:
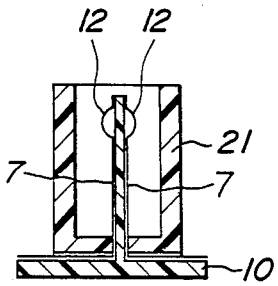
Figure 4B:
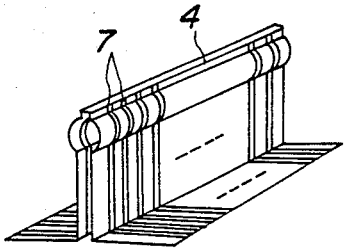
Figure 45A:
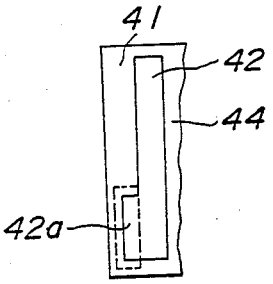
Figure 45B:
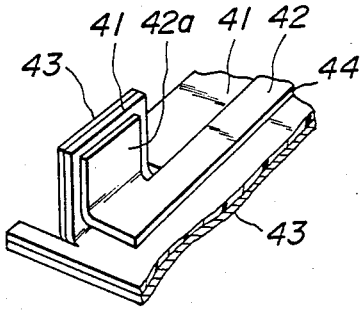

If the plastic layer of multi contacts having three layers as shown in FIG. 3*a* is thin, local batteries of different metals are often caused by electrical connections between springiness and conductive metal layers 43 and burrs caused when conductive metal layers are cut, so that there is a risk of the multi contacts being decayed by corrosion caused by the batteries. As shown in FIG. 3*b*, moreover, when the springiness metal layer is commonly provided for the conductive metal layers, there is a risk of the conductive metal layers or multi contacts being short-circuited by the springiness metal layer due to burrs. In order to avoid this, for example, as shown in FIG. 45*a*, projections 42*a* of the conductive metal layers 42 are made smaller than those to be cut and raised (shown in dotted lines in FIG. 45*a*). As the result, as shown in FIG. 45*b*, the cut edges of the springiness metal layer 43 and conductive metal layer 42 are sufficiently spaced apart from each other, thereby preventing the short-circuit.

Figure 46:
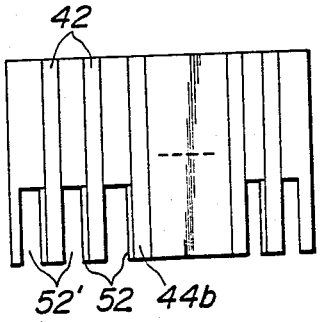

As shown in FIG. 46, moreover, metal layers 42 may be formed on a plastic layer 41 may be cut starting from the proximity of ends of the metal layers 42 without leaving the plastic at the ends of the metal layers 42. Even if the mechanical strength of the multi contacts at the ends of the metal layers 42 is decreased, a wire positioning wall forming plate (not shown) serves to reinforce the multi contacts.

Figure 47:
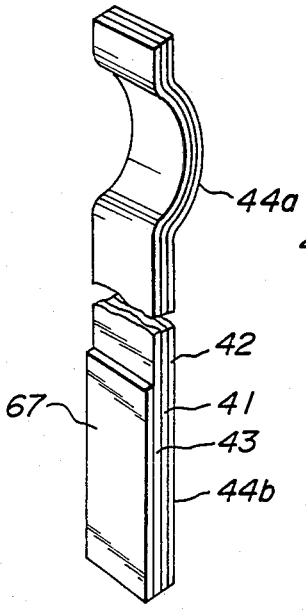
FIGS. 47–50 illustrate further embodiments of multi contacts according to the invention.
Figure 48A:
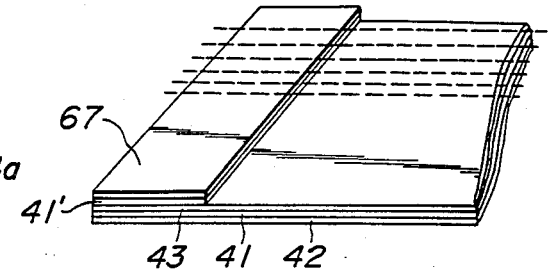
Figure 48B:
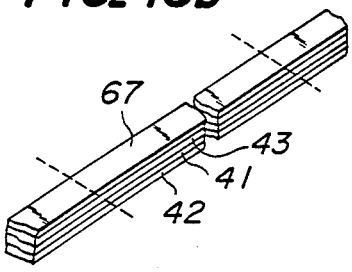
Figure 49:
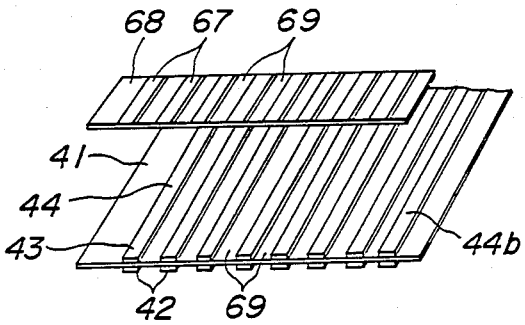

In one embodiment of the invention for more improving the soldering a wire, as shown in FIG. 47, a conductive metal layer 67 is provided on a plastic layer 41 on a side opposite to a conductive layer 42 and extending corresponding to a terminal element 44*b* (or throughout the length of this contact). The provision of the conductive metal layer 67 is effected in the following manner. In case of single contacts, on a plastic layer 41 in the form of a plate or stripe are provided a conductive metal layer 42 and a springiness metal layer 43 and thereafter a metal layer 67 the same in property as the conductive metal layer 42 is provided on the springiness metal layer 43 through a plastic layer 41' as shown in FIGS. 48*a* and 48*b* and cut along dotted lines in FIG. 48*a*. In case of multi contacts, on the other hand, the assembly of the metal layers 42 and 43 and the plastic layer 41 formed as in FIG. 48*a* is, for example, partially chemically etched so as to remove unnecessary portions of the metal layers 42 and 43 to form contacts 44 as shown in FIG. 49. Metal layers 67 are attached to a separate plastic layer 68 as with the same intervals as those of the terminal elements 44*b* to form a composite plate as shown in FIG. 49. The composite plate is then attached to the contacts 44 and thereafter portions 69 on both sides of the metal layers 67 are removed in order to separate the individual terminal elements 44*b*.

In this manner, substantially outer circumferential surfaces of the terminal elements 44*b* are those of the conductive metal layers, so that solder substantially completely spreads all over the outer circumferential surfaces of the terminal elements 44*b* when the terminal elements 44*b* inserted in terminal element apertures of a printed circuit board are soldered thereat. Accordingly, the terminal elements 44*b* are securely soldered to the board and connected to the circuit under a good condition. As the soldered portion is rigid, there is a considerably less chance of the connection being failed due to a force acting upon the terminal elements when a mating connector is removed.

Figure 50:
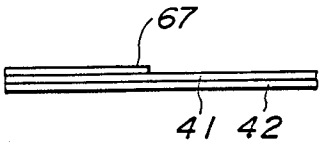

In the above embodiment, the plastic layer sandwiched by the conductive and springiness metal layers has been explained. According to the invention, however, a conductive metal layer 67 may be provided on a plastic layer 41 having only a conductive metal layer 42 on the opposite side thereof for the same purpose as shown in FIG. 50.

Figure 51A:
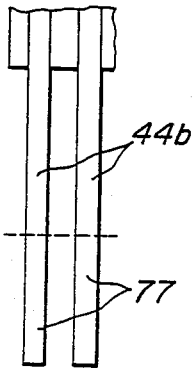
FIGS. 51–56 illustrate various embodiments of multi contacts according to the invention.
Figure 52A:
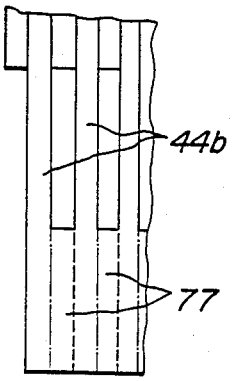
Figure 53A:
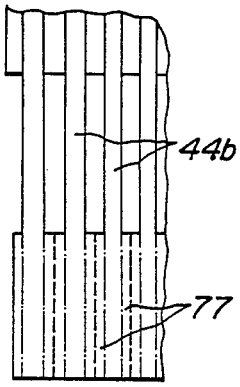
Figure 51B:
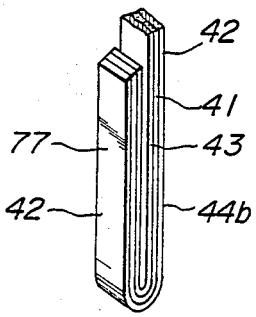
Figure 52B:
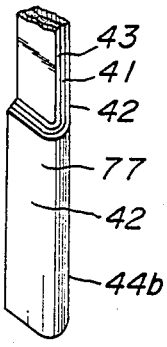
Figure 53B:
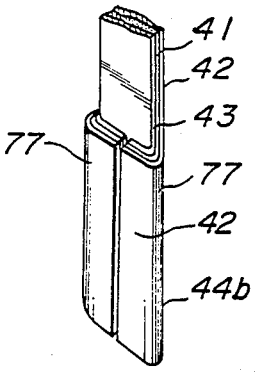

In further embodiments of the invention, terminal elements 44*b* are provided with turn-up portions 77 as shown in FIGS. 51*a*, 52*a* and 53*a*. The turn-up portions 77 are turned up or folded along broken lines as shown in FIG. 51*b* or FIGS. 52*b* and 53*b* after the terminal elements are cut along dot-and-dash lines, thereby forming terminal elements 44*b* only by the conductive metal layers. The embodiment shown in FIG. 51*a* is suitable for a single contact, wherein the terminal element 44*b* is formed twice the normal length to provide the turn-up portion 77 which is folded along a traverse line. The embodiments shown in FIGS. 52*a* and 53*a* are suitable for multi contacts. In FIG. 52*a*, the terminal elements are provided on one sides with turn-up portions 77 having the conductive metal layers, whose widths are substantially equal to those of the terminal elements. The turn-up portions 77 are cut along broken lines and folded along dot-and-dash lines as as to expose the conductive metal layers 42. In FIG. 53*a*, the terminal elements are provided on both the sides thereof with turn-up portions having widths one half of those of the terminal elements and having the conductive metal layers. The turn-up portions are cut and folded to expose the conductive metal layers 42.

In these embodiments shown in FIGS. 51*a* and 51*b*–53*a* and 53*b*, the folding of the turn-up portions 77 can be effected at the same time when contacts are cut and folded in manufacturing the contacts without requiring any step, so that the manufacturing is simplified.

Figure 54:
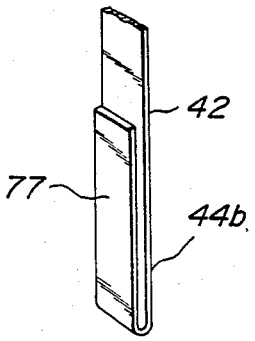
Figure 55:
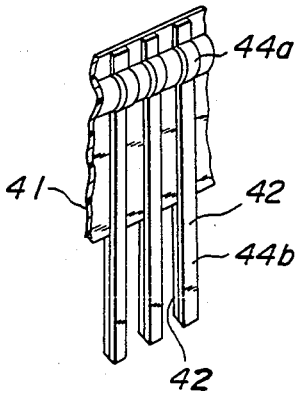
Figure 56:
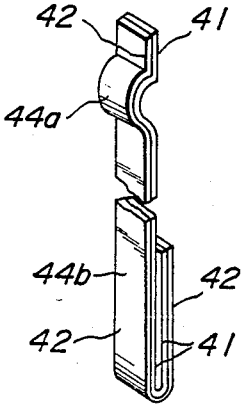

The turn-up portions 77 may be bonded at the folded portions by an adhesive. When the conductive metal layers 42 are sufficiently thick and there is no risk of the layers 42 being damaged in foldering, the plastic layer and the springiness metal layer at the terminal element may be dispensed with as shown in FIG. 54. Moreover, these embodiments may be applied to two layer contacts, each consisting of a plastic layer and a metal layer as shown in FIGS. 55 and 56. In this case, a turn-up portion 77 may be formed by removing a plastic layer thereat or by extending a conductive layer from a plastic layer.

According to the embodiment of the invention shown in FIGS. 19*a*–19*d*, a great number of multi contacts having very narrow widths and with close intervals can be manufactured easily and exactly, so that small-sized and inexpensive multi contact connector can be produced.

Figure 19D:
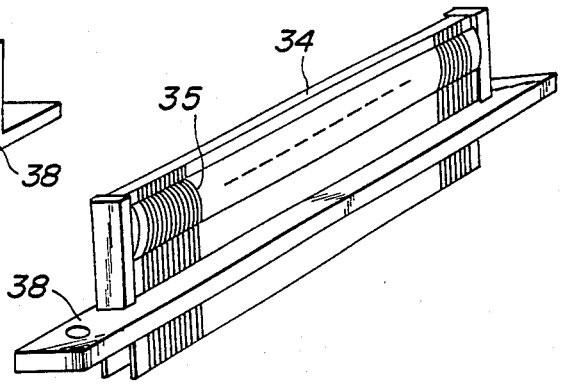
Figure 57:
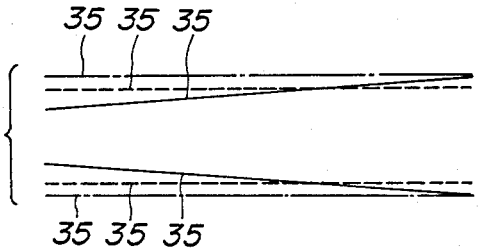
FIG. 57 is a schematic view for explaining an incorrect connection between contacts.
Figure 58A:
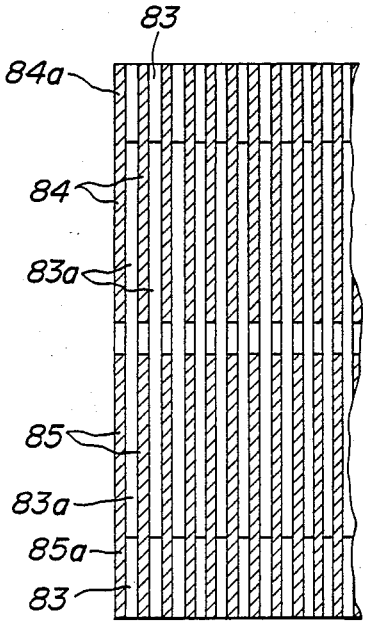
FIGS. 58–62 illustrate various embodiments of multi contacts according to the invention.
Figure 59A:
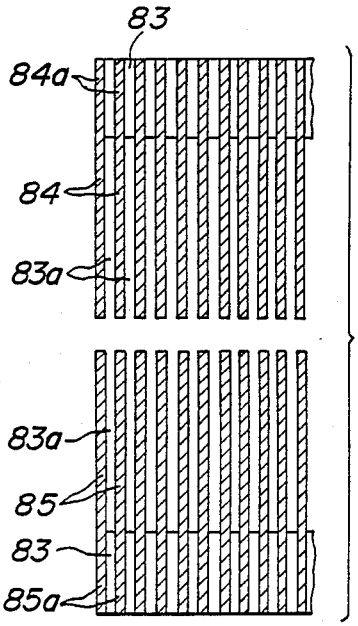
Figure 58B:
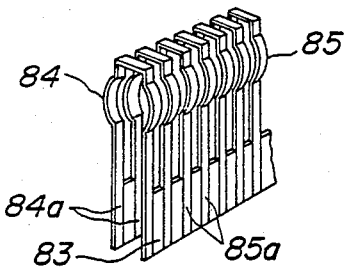
Figure 59B:
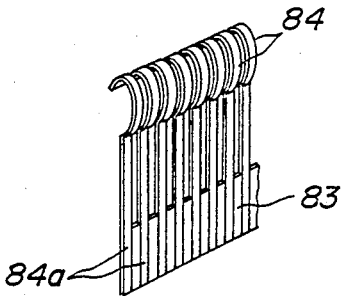

In this case, if only the first conductive metal layer 35 is etched to form contacts, the second springiness metal layer 36 is common to the contacts as shown in FIG. 18. In forming a male connector as shown in FIG. 19*d*, distances between opposite metal layers 35 may not be equal from the left end to the right end as viewed in FIG. 19*d* due to incorrectness in parallelism in foldering the layers or setting the layers in the insulating housing 38 of the connector. This incorrect parallelism is shown in solid lines on an exaggerated scale in FIG. 57. Therefore, even if distances between opposite metal layers of a female connector are equal throughout its length as shown in broken lines in FIG. 57, the metal layers of the female connector are opened or forced away from each other by the metal layers of the male connector whose distance is the largest as shown in dot-and-dash lines in FIG. 57. Accordingly, there is a risk of the male and female connectors being connected only at the metal layers of the male connector, whose distances are the maximum.

In order to avoid this, according to a preferred embodiment of the invention, after metal layers in rows have been formed as shown in FIG. 19*a* by removing unnecessary portions of metal layers a and b shown in FIG. 17 by etching, plastic layer portions 83*a* concerning contact spring pressure between the metal stripes 84 and between the metal stripes 85 or such plastic layer portions 83*a* and springiness metal layer portions (not shown) are removed to form multi contacts connected only at the proximities of terminal portions 84*a* and 85*a* by the plastic layers 83 and the springiness metal layers as shown in FIGS. 58*a* and 58*b* and FIGS. 59*a* and 59*b*. In this manner, the metal layers 84 and 85 are independent in contact spring force from each other, so that even if distances between the metal layers 84 and 85 are not equal, they contact each other with individual spring forces to ensure reliable connections.

Figure 60A:
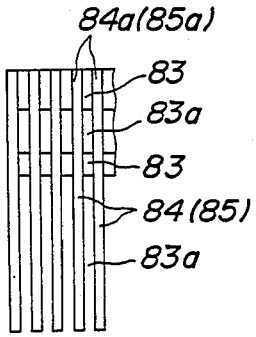
Figure 60B:
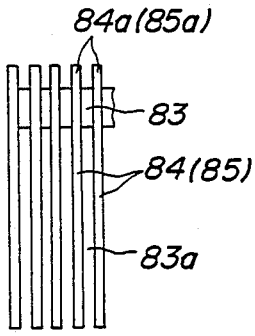
Figure 61:
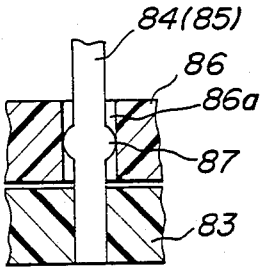

Plastic layers portions may be removed at two locations 83*a* as shown in FIG. 60*a* or in a manner terminal elements 84*a* and 85*a* extend as shown in FIG. 60*b*. In fixing the contact 84 or 85 in an insulating housing 86 by press fitting the contact in an aperture 86*a* of the housing, the plastic layer is removed so as to leave fixing projections 87 of the plastic layer having a width larger than a diameter of the aperture 86*a* as shown in FIG. 61. In this case, however, as the projections 87 has not enough strength, the plastic portion having the projections 87 is formed together with the attached metal layers.

Figure 62:
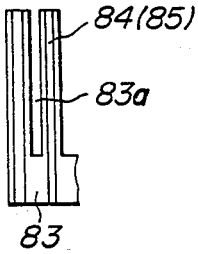

In the event of a very thin plastic layer 83, when it is punched to remove unnecessary portions, there is a risk of the conductive and springiness metal layers being short-circuited by burrs occurring at their peripheries. Accordingly, if the springiness metal layer 82 is common to the conductive metal layers 81, the conductive metal layers 81 forming respective contacts may be electrically connected through the common springiness metal layer 82. To avoid this, a plastic layer is punched so as to leave plastic portions on both sides of metal layers 84 or 85 as shown in FIG. 62. The above embodiments can be applied to multi contacts produced from the plate comprising one metal layer provided only one surface of a plastic layer as shown in FIG. 15*b*.

Figure 63A:
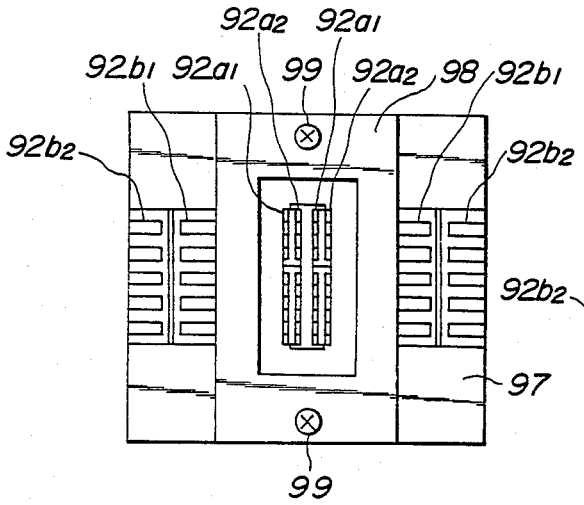
FIGS. 63*a*, 63*b*, 64*a* and 64*b* illustrate examples of multi contact connectors.
Figure 63B:
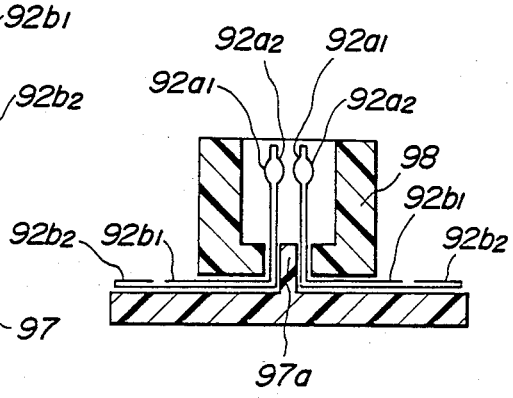
Figure 64A:
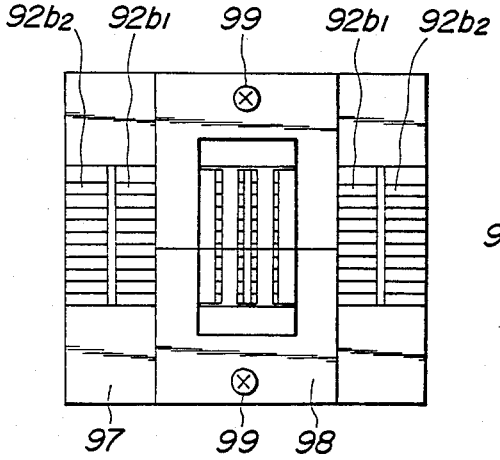
Figure 64B:
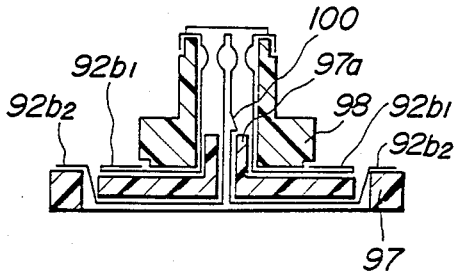

In order to reconsider the connectors according to the invention as shown in FIGS. 21*a* and 21*b*, these connectors are shown in plan views in FIGS. 63*a* and 64*a* together with their sectional views with new reference numerals in FIGS. 63*b* and 64*b*. As shown in the plan views of FIGS. 63*a* and 64*a*, intervals of terminal elements $92b_1$ and $82b_2$ are equal and hence aligned with each other. This arrangement makes it difficult to connect flat cables thereto, whose lead wires are arranged in parallel with each other in the form of a flat plate. Moreover, the lead wires connected to the terminal elements $92b_1$ are located above the terminal elements $92b_2$, so that their connections are difficult and they are concentrated in two rows. In these drawings, reference numerals 99 denote set screws and a reference numeral 100 denotes a protrusion for preventing the terminal element from removing from the housing.

Figure 65A:
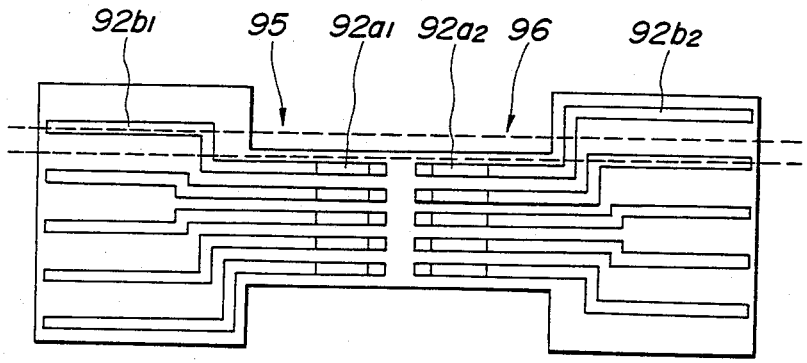
FIGS. 65–68 illustrate embodiments of multi contacts according to the invention.
Figure 65B:
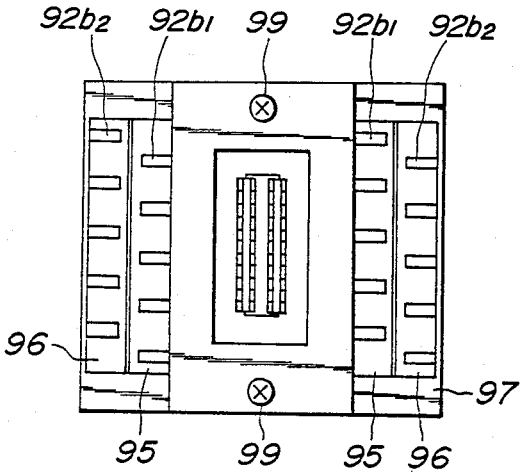

According to one embodiment of the invention to solve this problem, terminal elements $92b_1$ and $92b_2$ of multi contacts 95 and 96 are so arranged by selecting their intervals and positions as to locate the terminal elements $92b_2$ between the terminal elements $92b_1$ keeping intervals therebetween as shown in FIG. 65*a* illustrating the relation between the terminal elements $92b_1$ and $92b_2$ by broken lines. As the result, the terminal elements $92b_1$ and $92b_2$ are located staggered with each other as shown in FIG. 65*b*, so that the above mentioned difficulty in connecting lead wires can be eliminated. In this case, moreover, distances between the terminal elements $92b_1$ and $92b_2$ are more than twice distances between contact elements $92a_1$ and $92a_2$. Moreover, positive widening of intervals between the terminal elements $92b_1$ and between the terminal elements $92b_2$ makes easy the connection of lead wires to multi contact connectors whose a great number of fine or very small contacts are arranged with very narrow intervals, which would otherwise be very difficult.

Figure 66:
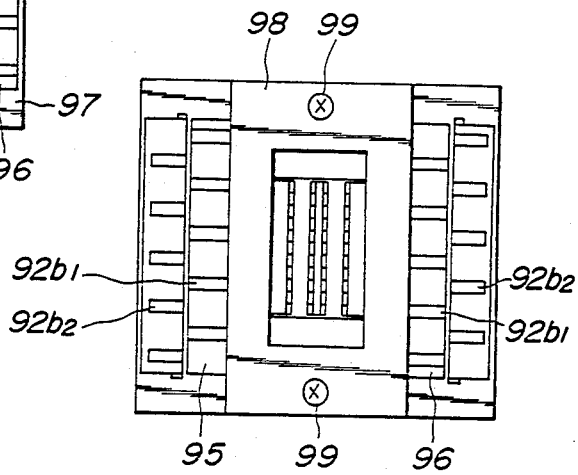

With the female multi contact connector as shown in FIGS. 64*a* and 64*b*, the same effect can be obtained in the same manner as in FIGS. 65*a* and 65*b*. This is shown in a plan view of FIG. 66. Although the above embodiments have been shown with the terminal elements horizontally extending, the invention may be applied to multi contacts whose terminal elements vertically extend.

Figure 67A:
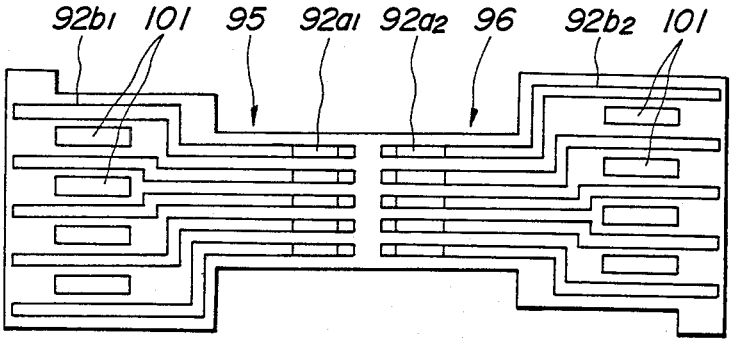
Figure 67B:
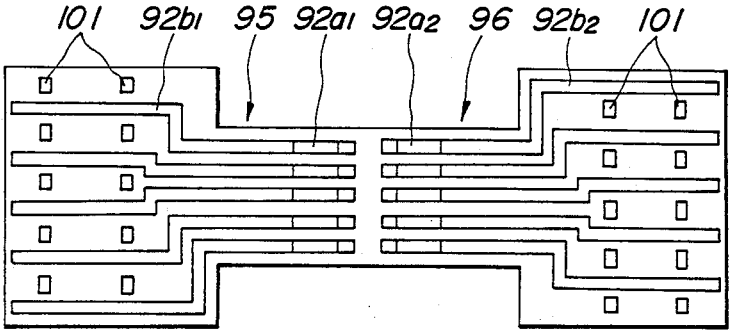
Figure 68A:
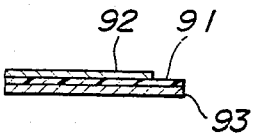
Figure 68B:
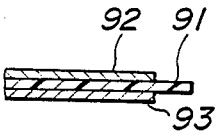

In another embodiment shown in FIG. 67*a*, a plastic layer is formed with openings 101 between terminal elements $92b_1$ and $92b_2$ at locations to be bent, thereby making easy the bending and foldering. The shown openings 101 are elongated in axial directions of the terminal elements, which facilitate bending at plural locations because the openings extend in the axial directions. On the other hand, openings 101 shown in FIG. 67*b* are elongated in transverse directions of terminal elements. These openings are located at plural bending positions, respectively.

In order to ensure the insulation between the terminal elements $92b_1$ and the terminal elements $92b_2$ therebelow, moreover, it is preferable to retract ends of conductive metal layers 92 or ends of both the conductive and springiness metal layers 92 and 93 from an end of a plastic layer 91.

Figure 69:
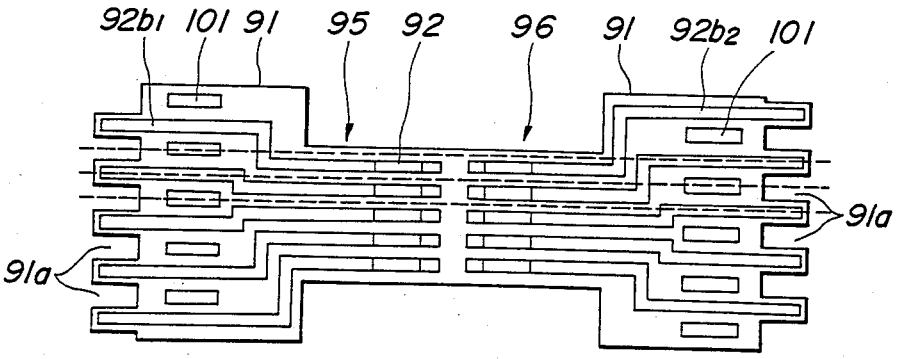
FIG. 69 shows a further embodiment of multi contacts according to the invention.
Figure 70:
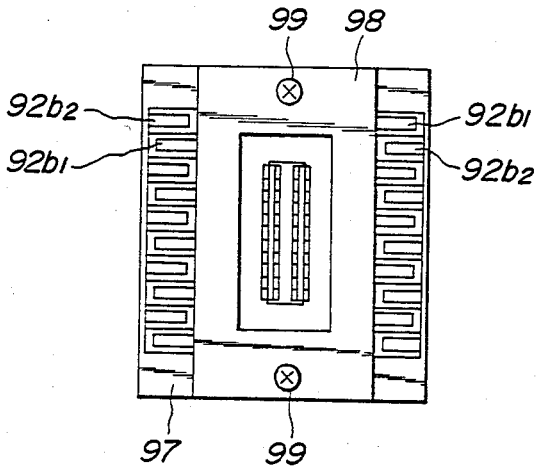
FIG. 70 illustrate a multi contact connector using the multi contacts shown in FIG. 69.

In a further embodiment of the invention, plastic portions 91*a* at ends of a plastic layer 91 are removed to make easy the bending of the terminal elements as shown in FIG. 69. A connector using such multi contacts is shown in FIG. 70.

While the invention has been particularly shown and described with reference to preferred embodiments thereof, it will be understood by those skilled in the art that the foregoing and other changes in form and details can be made therein without departing from the spirit and scope of the invention.

What is claimed is:

1. An electric contact comprising a first conductive metal layer, a second springy metal layer and a first plastic insulating layer interposed between said first and second metal layers, these layers forming a unitary laminated contact.

2. An electric contact as set forth in claim 1, wherein said layers are at least partially bonded to one another.

3. An electric contact as set forth in claim 1, wherein said first metal layer is made of a conductive metal selected from the group consisting essentially of conductive metals, copper, silver, gold, aluminum and alloys of these metals, said second metal layer is made of a metal selected from the group consisting essentially of iron, copper, cobalt, titanium, zirconium and nickel base alloys, and said plastic layer selected from the group consisting essentially of phenol, amino, epoxide, furan, polyether, allyl, polyimide, polyamide, polyester, polycarbonic ester, polyphenylene sulfide, polyolefin, vinyl and silicone resins.

4. An electric contact as set forth in claim 1, wherein said first and second layers are bonded to said plastic layer by a heat-adherent adhesive.

5. An electric contact as set forth in claim 1, wherein said first and second metal layers are formed on said plastic layer by means of a method selected from electroplating, vapor deposition and spattering.

6. An electric contact as set forth in claim 1, further comprising a third metal layer between said first and said second metal layer and on one side of said plastic layer, and a second plastic layer adjacent said third metal layer and opposite said first plastic layer to form two contact integrally formed back to back.

7. An electric contact as set forth in claim 1, wherein said second metal layer comprises two layers separated from each other and from said first metal layer.

8. An electric contact as set forth in claim 1, wherein said plastic layer between said first and second metal layer extends beyond the edges of the metal layers.

9. An electric contact as set forth in claim 8, wherein the portions of said plastic layer which extend beyond the edges of the metal layers are bent.

10. An electric contact as set forth in claim 1, wherein said contact has at least one obliquely cut edge to prevent burrs when cutting.

11. An electric contact as set forth in claim 1, wherein said second metal layer is removed to form two layers comprising said first metal layer and said plastic layer.

12. An electric contact as set forth in claim 11, wherein said first metal layer is springy.

13. An electric contact as set forth in claim 11, wherein said first metal layer is made of a metal selected from the group consisting essentially of iron, copper, cobalt, titanium, zirconium and nickel base alloys.

14. An electric contact as set forth in claim 11, wherein said plastic layer is springy.

15. An electric contact as set forth in claim 11, wherein said plastic layer is conductive.

16. An electric contact as set forth in claim 1, wherein said first metal layer consists of a plurality of first metal stripes in parallel with each other and said second metal layer consists of a plurality of second metal stripes which are aligned with the first metal stripes through said plastic layer.

17. An electric contact as set forth in claim 1, wherein said first metal layer consists of a plurality of first metal stripes in parallel with each other and said second metal layer consists of a plurality of second metal stripes substantially parallel to said first metal stripes and each extending over an adjacent pair of said first metal stripes.

18. An electric contact as set forth in claim 1, wherein said first metal layer consists of a plurality of first metal stripes in parallel with each other.

19. An electric contact as set forth in claim 1, wherein said first metal layer consists of a plurality of first metal stripes in parallel with each other and having terminal elements, and plastic parts of substantially rectangular shapes of said plastic layer, which plastic layer is at least on one side of said terminal elements of said first metal stripes, to form wire positioning walls substantially at right angles to said terminal elements.

20. An electric contact as set forth in claim 19, further comprising plural rows of said plastic parts perpendicular to said terminal elements.

21. An electric contact as set forth in claim 20, wherein said wire positioning walls include plastic parts on both the sides of each of said terminal elements, and further including wire positioning walls at each of said terminal elements and alternately in adjacent rows.

22. An electric contact as set forth in claim 20, further comprising said wire positioning walls on one side of said terminal elements and only on opposite sides of said terminal elements alternately in said rows.

23. An electric contact as set forth in claim 20, further comprising said wire positioning walls only on one side of said terminal elements in all said rows.

24. An electric contact as set forth in claim 1, wherein said first metal layer consists of a plurality of first metal stripes in parallel with each other and having terminal elements, said metal stripes having projections on both sides of said terminal elements, said projections being at right angles to said terminal elements to form said wire positioning walls.

25. An electric contact as set forth in claim 19, wherein said plastic parts are formed by cutting said plastic layer starting from edges thereof at ends of terminal elements of said metal stripes.

26. An electric contact as set forth in claim 25, further comprising an insulating plate attached to said plastic layer on the side thereof opposite said positioning walls to reinforce said terminal elements.

27. An electric contact as set forth in claim 1, wherein said first metal layer consists of a plurality of first metal stripes in parallel with each other and having terminal elements, said plastic layer being between said terminal elements of said first metal stripes and having wire positioning wall apertures through which snugly extend wire positioning walls formed on a wire positioning wall forming plate attached to said unitary laminated contact on an opposite side of said metal stripes.

28. An electric contact as set forth in claim 27, further comprising conductive metal layers on said wire positioning walls except on the upper surfaces of the wire positioning walls and bottom surfaces between the positioning walls.

29. An electric contact as set forth in claim 27, wherein said wire positioning wall forming plate is an insulating plate with conductive metal layers thereon at intervals corresponding to distances between terminal elements, said insulating plate being bent such that the two adjacent conductive metal layers are in opposition to each other to form said wire positioning walls.

30. An electric contact as set forth in claim 27, wherein said plastic parts are formed by cutting said plastic layer starting from edges thereof at ends of terminal elements of said metal stripes.

31. An electric contact as set forth in claim 1, wherein said metal layer consists of a plurality of first metal stripes in parallel with each other and having terminal elements, and said contact further comprising first wire positioning walls at least on one side of said terminal elements and substantially at right angles to said terminal elements, said walls having wire positioning wall apertures through which separate wire positioning walls formed on a wire positioning wall forming plate attached to the contact extend to form wire positioning walls in conjunction with the first wire positioning walls on both sides of the terminal elements.

32. An electric contact as set forth in claim 1, wherein said first metal layer consists of a plurality of first metal stripes in parallel with each other and having terminal elements, said metal stripes being provided on one side of said terminal elements with substantially rectangular first wire positioning walls of the same material as the first metal stripes and substantially at right angles to said terminal elements, said walls having wire positioning wall apertures through which separate wire positioning walls formed on a wire positioning wall forming plate of an insulating material attached to the contact extend to form wire positioning walls in conjunction with the first wire positioning walls on both sides of the terminal elements, said separate wire positioning walls including substantially rectangular conductive metal layers formed on said wire positioning wall forming plate at intervals substantially equal to those of said first metal stripes.

33. An electric contact as set forth in claim 32, wherein said wire positioning walls are made smaller than layers to be cut and raised under said walls.

34. An electric contact as set forth in claim 32, wherein layers under said walls are cut starting from edges thereof at ends of said terminal elements to form said wire positioning wall apertures.

35. An electric contact as set forth in claim 1, wherein a third metal layer of the same material as said first metal layer is provided on the side of said second metal layer opposite said first metal layer.

36. An electric contact as set forth in claim 1, wherein said first metal layer consists of a plurality of first metal stripes in parallel with each other and having terminal elements, said terminal elements extend along and are folded along lines substantially transverse to the terminal elements to expose the first metal layer.

37. An electric contact as set forth in claim 1, wherein said first metal layers consists of a plurality of first metal stripes in parallel with each other and having terminal elements, said terminal elements of said metal stripes having projections extending on one side of the terminal elements which are folded to expose the first metal layer.

38. An electric contact as set forth in claim 1, wherein said first metal layer consists of a plurality of first metal stripes in parallel with each other and having terminal elements, said terminal elements of said metal stripes having projections extending on both sides of the terminal elements which are folded to expose the first metal layer.

39. An electric contact as set forth in claim 1, wherein said first metal layer consists of a plurality of first metal stripes in parallel with each other and having terminal elements, and at least parts of said plastic layer among said plastic layer and said second metal layer are removed to connect said metal stripes only by the proximities of terminal elements of said metal stripes.

40. An electric contact as set forth in claim 39, wherein the removal of the layers are effected in plural rows in directions substantially transverse to said metal stripes.

41. An electric contact as set forth in claim 39, wherein said plastic layer includes fixing projections for press fitting the contact in an aperture of a housing.

42. An electric contact as set forth in claim 39, wherein said plastic layer comprises plastic portions surrounding said terminal elements.

43. An electric contact as set forth in claim 1, wherein said first metal layer consists of a plurality of first metal stripes in parallel with each other and having terminal elements, said stripes forming two groups of multi contacts on a same insulating plate for use in a multi contact connector, and said terminal elements of said metal stripes not being aligned with each other in their longitudinal directions when they are arranged in a housing of a connector.

44. An electric contact as set forth in claim 42, having an opening between each said two adjacent shifted terminal elements to facilitate bending of the multi contacts.

45. An electric contact as set forth in claim 43, having a plurality of openings each between said adjacent shifted terminal elements to facilitate bending of the multi contacts.

46. An electric contact as set forth in claim 1, wherein an end of at least one of said first and second metal layers is retracted from an end of said plastic layer.

47. An electric contact as set forth in claim 43, wherein plastic portions of the plastic layer between said terminal elements are removed so that said terminal elements of said multi contacts are partially interposed with each other while they are not aligned with each other in their longitudinal directions.

48. A multi contact connector including two groups of multi contacts, each said group of multi contacts comprising a plurality of conductive metal stripes in parallel with each other and having terminal elements, said stripes being mounted on a plastic insulating layer and a plurality of springy metal stripes aligned with said conductive metal stripes on an opposite side of said plastic layer, said terminal elements of said conductive metal stripes being shifted away from each other in their longitudinal directions when they are arranged in a housing.

49. A multi contact connector as set forth in claim 48, having at least one opening each between said two adjacent shifted terminal elements.

50. A multi contact connector as set forth in claim 48, wherein an end of at least one of said conductive and springy stripes is retracted from an end of said plastic layer.

51. A multi contact connector as set forth in claim 48, wherein plastic portions of the plastic layer between said terminal elements are removed so that said terminal elements of said mulit contacts are partially interposed with each other and are not aligned in their longitudinal directions.

* * * * *